US011817631B2

(12) United States Patent
Fleancu et al.

(10) Patent No.: US 11,817,631 B2
(45) Date of Patent: Nov. 14, 2023

(54) ANTENNA ARRANGEMENT FOR MOBILE RADIO SYSTEMS WITH AT LEAST ONE DUAL-POLARISED TURNSTILE ANTENNA

(71) Applicant: Telefonaktiebolaget LM Ericsson (publ), Stockholm (SE)

(72) Inventors: Dan Fleancu, Griesstätt (DE); Andreas Vollmer, Rosenheim (DE); Wolfgang Heyde, Tuntenhausen (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 183 days.

(21) Appl. No.: 17/593,658

(22) PCT Filed: Mar. 20, 2020

(86) PCT No.: PCT/EP2020/057760
§ 371 (c)(1),
(2) Date: Sep. 22, 2021

(87) PCT Pub. No.: WO2020/193401
PCT Pub. Date: Oct. 1, 2020

(65) Prior Publication Data

US 2022/0200168 A1 Jun. 23, 2022

(30) Foreign Application Priority Data

Mar. 22, 2019 (DE) ..... 102019107476.2
Apr. 4, 2019 (DE) ..... 102019108901.8

(51) Int. Cl.
*H01Q 9/28* (2006.01)
*H01Q 21/26* (2006.01)
*H01Q 5/42* (2015.01)

(52) U.S. Cl.
CPC ..... *H01Q 21/26* (2013.01); *H01Q 5/42* (2015.01); *H01Q 9/28* (2013.01)

(58) Field of Classification Search
CPC ..... H01Q 21/26; H01Q 21/00; H01Q 21/20; H01Q 5/42; H01Q 9/28; H01Q 9/285
See application file for complete search history.

(56) References Cited

U.S. PATENT DOCUMENTS 4,184,163 A 1/1980 Woodward
4,414,550 A * 11/1983 Tresselt ..... H01Q 21/20 342/373

(Continued)

FOREIGN PATENT DOCUMENTS

DE 19627015 A1 1/1998
DE 19722742 A1 12/1998

(Continued)

OTHER PUBLICATIONS

International Search Report and Written Opinion for International Patent Application No. PCT/EP2020/057760, dated Jun. 25, 2020, 16 pages.

*Primary Examiner* — Tho G Phan
(74) *Attorney, Agent, or Firm* — Withrow & Terranova, PLLC

(57) ABSTRACT

An antenna arrangement comprises a dual-polarised turnstile antenna, which comprises a first and a second dipole antenna element, which are aligned perpendicular to one another. The first and second dipole antenna elements each comprises two dipole halves. The dipole halves of both dipole antenna elements comprise a dipole section and a coupling section, which are galvanically connected to each other and to a first end of a ground connection medium or a signal connection medium. The coupling sections each extend along the closest dipole section of the adjacent other first and/or second dipole antenna element, wherein a spacing gap is formed between a coupling side of the respective coupling section of the first and/or second dipole antenna (Continued)

element and the respective adjacent dipole section of the second and/or dipole antenna element.

20 Claims, 16 Drawing Sheets

(56) References Cited

U.S. PATENT DOCUMENTS

| | | | | |
|---|---|---|---|---|
| 4,434,425 | A * | 2/1984 | Barbano | H01Q 19/17 343/797 |
| 5,208,602 | A * | 5/1993 | Monser | H01Q 21/26 343/807 |
| 5,321,414 | A * | 6/1994 | Alden | H01Q 1/248 343/815 |
| 6,069,590 | A | 5/2000 | Thompson, Jr. et al. | |
| 6,072,439 | A | 6/2000 | Ippolito et al. | |
| 6,747,606 | B2 | 6/2004 | Harel et al. | |
| 6,940,465 | B2 * | 9/2005 | Gottl | H01Q 1/246 343/815 |
| 7,358,924 | B2 * | 4/2008 | Boss | H01Q 1/246 343/853 |
| 2005/0253769 | A1 | 11/2005 | Timofeev et al. | |
| 2014/0028516 | A1 | 1/2014 | Semonov et al. | |
| 2017/0125917 | A1 | 5/2017 | Lin et al. | |

FOREIGN PATENT DOCUMENTS

| | | | |
|---|---|---|---|
| EP | 1156549 | A2 | 11/2001 |
| EP | 1772929 | A1 | 4/2007 |
| EP | 2672568 | A2 | 12/2013 |
| FR | 2863111 | A1 | 6/2005 |
| WO | 2014018600 | A1 | 1/2014 |
| WO | 2018224666 | A1 | 12/2018 |

* cited by examiner 2, 2a, 3, 3a

ANTENNA ARRANGEMENT FOR MOBILE RADIO SYSTEMS WITH AT LEAST ONE DUAL-POLARISED TURNSTILE ANTENNA

This application is a 35 U.S.C. § 371 national phase filing of International Application No. PCT/EP2020/057760, filed Mar. 20, 2020, which claims the benefit of German Patent Application No. DE102019107476.2, filed Mar. 22, 2019, and German Patent Application No. DE102019108901.8, filed Apr. 4, 2019, the disclosures of which are incorporated herein by reference in their entireties.

BACKGROUND

The invention relates to an antenna arrangement for mobile radio systems with at least one dual-polarised turnstile antenna.

Dipole antenna elements are known, for example, from the prior art documents DE 197 22 742 A, DE 196 27 015 A, U.S. Pat. No. 2,014,028 516 A1, WO 2014 018 600 A1 and US 41 841 63 A1. Such dipole antenna elements can have a conventional dipole structure or may consist, for example, of a turnstile antenna or a dipole square, etc.

Dipole antenna elements of this type are usually fed by connecting a dipole or emitter half with an outer conductor through direct current (i.e., in a galvanic manner), or in a capacitive or inductive (i.e. electromagnetic) manner, whereas the inner conductor of a coaxial connecting cable is connected to the second dipole or emitter half through direct current (i.e., in a galvanic manner once again) or in a capacitive or inductive manner.

A disadvantage of the turnstile antennas known from prior art is that the production cost is high and the dipole antenna elements cannot be operated as broadband as desired.

It is therefore the object of the present invention to provide an antenna arrangement, in particular for mobile radio systems, with at least one dual-polarized turnstile antenna, with the turnstile antenna being able to be operated at a greater broadband capacity than previous turnstile antennas. In this context, the electrical properties should be better than those of existing turnstile antennas, even at low frequency ranges. Frequency ranges from 698 to 960 MHz are particularly desirable. Lower frequencies should also be achieved.

This object is achieved by the antenna arrangement according to the invention as described in claim 1. Advantageous embodiments of the antenna arrangement according to the invention can be found in the dependent claims.

BRIEF SUMMARY

The antenna arrangement according to the invention comprises at least one dual-polarised turnstile antenna. This antenna is arranged on a reflector arrangement and comprises a first dipole antenna element and a second dipole antenna element. Both dipole antenna elements are aligned perpendicular to each other. Both dipole antenna elements each comprise two dipole halves. The first dipole half of the first dipole antenna element comprises a ground connection medium, a dipole section, and a coupling section. The dipole section and the coupling section are galvanically connected to one another and to a first end of the ground connection medium. A second end of the ground connection medium, which lies opposite the first end, is arranged on the reflector arrangement. The same applies to the first dipole half of the second dipole antenna element. The second dipole half of the first dipole antenna element also comprises a dipole section and a coupling section as well as a signal connection medium. The dipole section and the coupling section are galvanically connected to one another and to a first end of the signal connection medium, with a second end of the signal connection medium, which lies opposite the first end, being arranged on the reflector arrangement. The same also applies to the second dipole half of the second dipole antenna element. The signal connection medium of the first dipole antenna element preferably runs parallel or with one component substantially parallel to the ground connection medium of the first dipole antenna element. The same also applies to the signal connection medium of the second dipole antenna element in relation to the ground connection medium. The dipole sections of the respective dipole antenna element run in the opposite direction.

This means that the respective dipole section extends outward from the respective first end of the ground connection medium or signal connection medium, in particular radially away from this first end. The signal connection medium of the first dipole antenna element is preferably galvanically connected to a first feed system (in particular at its second end). The same preferably also applies to the signal connection medium of the second dipole antenna element. In order to increase the broadband capability, the coupling section of the first dipole antenna element extends along the nearest dipole section of the adjacent second dipole antenna element. A spacing gap is formed between a coupling side of the respective coupling section of the first dipole antenna element and the respective adjacent dipole section of the second dipole antenna element, as a result of which a capacitive coupling occurs between the respective coupling section and the adjacent dipole section. The same also applies to the coupling section of the second dipole antenna element, which extends along to the nearest dipole section of the adjacent next dipole antenna element.

The bandwidth capability of the turnstile antenna (i.e., the compactness of the emitter impedance) for subsequent impedance transformations is improved by using the corresponding coupling section via which a capacitive coupling to the neighbouring dipole section can be established. The bandwidth and emission characteristics are improved by a "capacitive coupling with the orthogonal dipole" and/or a "symmetrisation" of the (supplied) field/current and/or the excitation of a "parasitic emitter."

Very long and complex developments have shown that particularly good results can be achieved if the at least one coupling section has approximately the same circumferential length or resonance length as the dipole section to which the coupling section is galvanically connected. The word "approximately" includes deviations of less than +/−30%, 25%, 20%, 15%, 10%, or less than 5%.

Preferably, at least one dipole section or all dipole sections have a plate-like shape. They extend by a length l away from the first end of the respective ground connection medium or signal connection medium and have a height h (in the direction of the reflector) and a thickness d, with the height h being greater than the thickness d. The at least one coupling section or all of the sections also preferably have a plate-like shape and extend a) over a length L from the first end of the ground connection medium or signal connection medium or from the dipole section of the same dipole half along the closest dipole section of the other dipole antenna element;

b) they also extend via a width B along the dipole section of the own dipole half.

The at least one coupling section or all of the sections have a thickness D that is smaller than the length L and the width B. The difference between a first sum of length l and height h of the dipole section and a second sum of length L and width B of that coupling section which is galvanically connected to the dipole section is preferably less than 30%, 25%, 20%, 15%, 10%, or less than 5% of the first or second sum. The first sum should preferably correspond to the second sum.

In an embodiment of the antenna arrangement, the at least one coupling section or all of the sections are galvanically connected to the respective dipole section of the same dipole half over their entire width B. Coupling sections, dipole sections, and ground connection supports or signal connection supports are preferably formed as one piece, which is either pressed and/or stamped and/or lasercut.

Furthermore, the length L of at least one coupling section or all of the sections is smaller than the length l of the closest dipole section of the other dipole antenna element. This means that the coupling section does not protrude from the closest dipole section. The width B of at least one coupling section is preferably also smaller than the length l of the dipole section with which it is galvanically connected. The coupling section does not protrude from the dipole section to which it is galvanically connected.

In a preferred embodiment, the at least one or all the coupling sections extend farthest away from their dipole section only in the area to which they are galvanically connected, and on which the coupling side is formed. As the width B increases, the coupling section preferably extends less far from its dipole section. The progression of this extent may in this case decrease in a stepped or continuous manner. This means that the open end of the coupling section, which is adjacent to the closest dipole section of the other dipole antenna element, is arranged farthest away from its own dipole section of the same dipole half. From this open end, the coupling section continues to run in the direction of its own dipole section. It is tapered, so to speak. This progression is stepped (one or more stages) or continuous.

The open end of the coupling section can also be bent in the direction of the reflector arrangement or away from the reflector arrangement, or it may run parallel to it. In particular, the open end on which the coupling side is formed, which runs adjacent to the closest dipole section of the adjacent dipole antenna element, can be arranged or bent in such a way that it runs, at least over a partial length:

a) parallel to the reflector arrangement, or b) converging on the reflector arrangement or c) diverging away from the reflector arrangement.

If the open end is bent away from the reflector arrangement, the height of the coupling section, that is to say the height by which it protrudes from the reflector arrangement, may increase.

To increase the coupling, it is also possible for at least one coupling section or all of the sections to comprise a coupling lug. This coupling lug can extend over the entire length L or only over part of the length L of the respective coupling section on its coupling side and is bent in the direction of the reflector arrangement. This increases the coupling surface and thus the coupling between the respective coupling section and the respective closest dipole section of the adjacent dipole antenna element.

In order to increase the length L of the coupling section, it would also be conceivable for an indentation to be made in the coupling side of the coupling section. As a result, the dimensioning mentioned above can also be maintained with longer or higher dipole sections.

The height of the dipole section preferably decreases from its connection to the first end of the ground connection medium or signal connection medium to its free end. The progression of the dipole section is particularly adapted to the progression of a housing cover.

The progression of the dipole section and the coupling section can be different. One dipole section or all dipole sections comprise at least one top surface (upper surface), bottom surface, end surface and two side surfaces. The top surface extends from the first end of the ground connection medium parallel to the reflector arrangement or inclined in the direction of the reflector arrangement and terminates at the end surface. The bottom surface extends from a first end of the ground connection medium or signal connection medium in the direction of the reflector arrangement, is inclined toward it and also ends at the end surface. The bottom surface is more inclined in the direction of the reflector arrangement than the top surface as a result of which the height of the first and second side surfaces is greater in the area of the end surface than in the area of the ground connection medium or signal connection medium. This means that the corresponding dipole section "diverges" in the direction of its free end. In this context, the corresponding coupling section may run parallel to the reflector arrangement. The coupling section therefore preferably runs along the top surface and ends at a distance from the end surface. An extension of the coupling section away from the dipole section increases step by step and/or continuously from the end area towards the open end of the coupling section at the closest dipole section of the adjacent dipole antenna element.

In principle, however, it would also be possible for the bottom surface to be inclined from the first end of the ground connection medium or signal connection medium in the direction of the reflector arrangement to a turning point and, more preferably, inclined again from this turning point in the other direction (i.e., away from the reflector arrangement) to the end surface, whereby the height of the first and second side surfaces is greater in the area of this turning point than in the area of the end surfaces. The corresponding coupling section could then, for example, comprise a first area and, additionally or alternatively, a second area. In the first area, the coupling section is preferably arranged parallel to the reflector arrangement and then transitions into a second area. In the second area, the coupling section is inclined and runs from the top surface via the side surface in the direction of the bottom surface and ends at the turning point. Here, too, an extension of the coupling section away from the dipole section starting from the turning point toward the open end of the coupling section at the closest dipole section of the adjacent dipole antenna element increases in a stepped and/or continuous manner.

In principle, the coupling sections and the dipole sections could also be rectangular with the coupling section or coupling sections being aligned parallel to the reflector arrangement and the dipole sections perpendicular to the reflector arrangement. Deviations of less than +/−5° would be conceivable. In this case, the coupling section would run perpendicular to its dipole section to which it is galvanically connected.

In a further embodiment according to the invention, the first dipole half of the first dipole antenna element and the first dipole half of the second dipole antenna element are formed in one piece. This means that the dipole section and the coupling section of the first dipole half of the first dipole antenna element and the dipole section and the coupling section of the first dipole half of the second dipole antenna element are electrically connected to the first end of a shared ground connection medium. This simplifies production and assembly.

The antenna arrangement preferably has further higher-frequency turnstile antennas. These have smaller dimensions than the at least one dual-polarised turnstile antenna and protrude from the same. When the antenna arrangement is seen from above, at least one of these higher-frequency turnstile antennas is partially (not completely) covered by the first or second dipole antenna element of the at least one dual-polarised turnstile antenna.

These higher-frequency turnstile antennas are preferably mounted on separate base bodies which are inserted into a corresponding opening in the reflector arrangement. This makes it possible for them to be pre-assembled.

The higher-frequency turnstile antennas are arranged in different rows (parallel) to each other. These different rows are at least partially shielded from one another by partition devices.

BRIEF DESCRIPTION OF THE DRAWINGS

Various exemplary embodiments of the invention are described below by way of example with reference to the drawings. The same items have the same reference numerals. The corresponding figures in the drawings show in detail.

DETAILED DESCRIPTION

Figure 1:
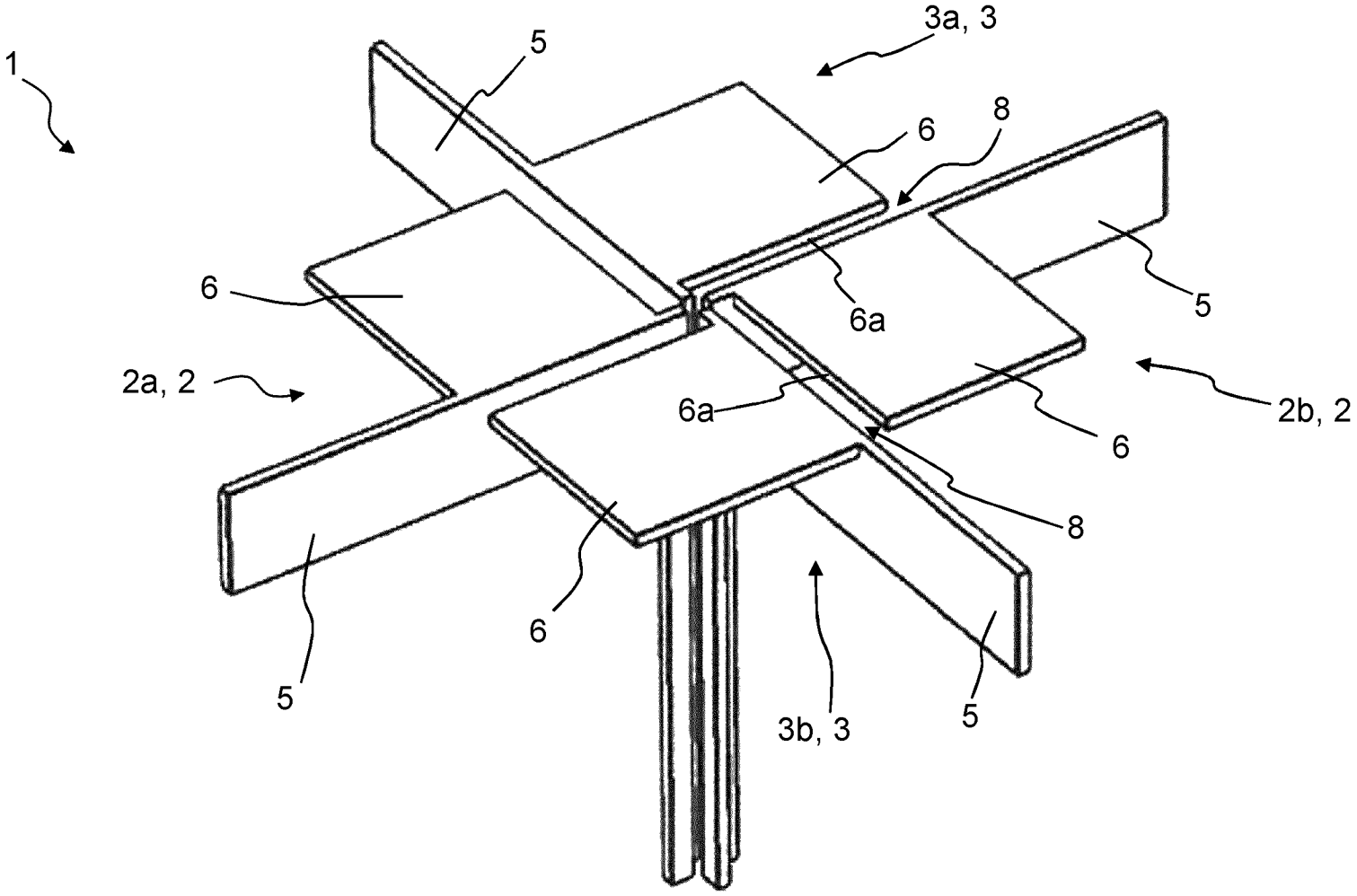
FIG. 1: a dual-polarised turnstile antenna for an antenna arrangement according to the invention.

The antenna arrangement 100 according to the invention, which comprises at least one novel dual-polarised turnstile antenna 1, is described below. Such a dual-polarised turnstile antenna 1 according to the invention is shown in FIG. 1.

Figure 2B:
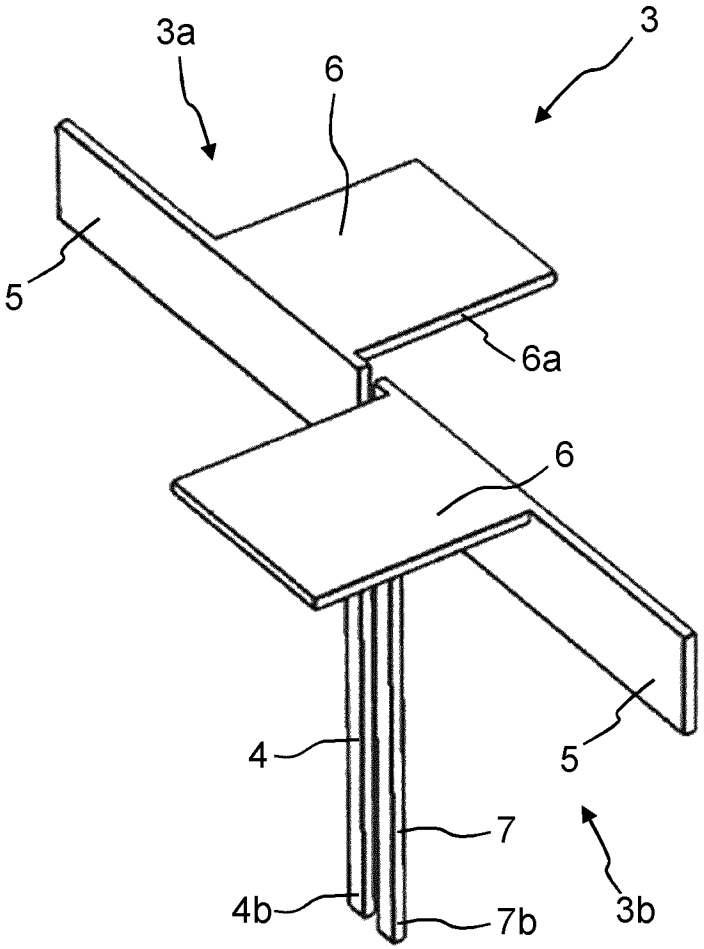
FIGS. 2A, 2B: a first dipole antenna element and a second dipole antenna element of the dual-polarised turnstile antenna.
Figure 2A:
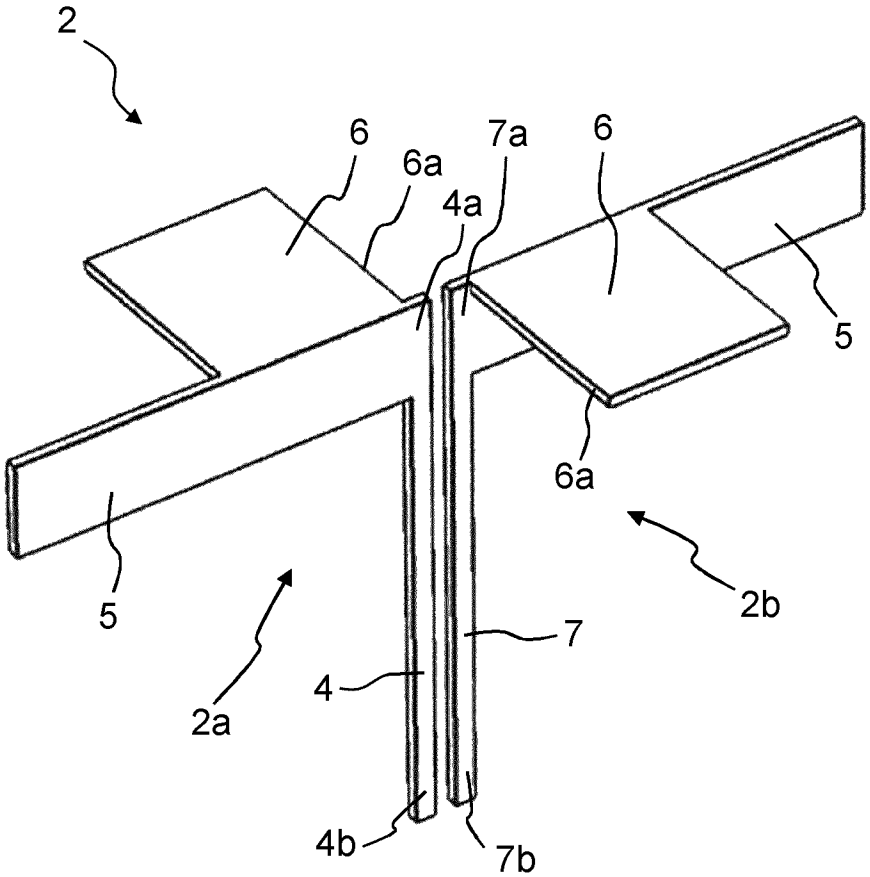

The at least one dual-polarised turnstile antenna 1 is arranged on a reflector arrangement 101 (see FIG. 8) and comprises a first dipole antenna element 2 and a second dipole antenna element 3. The first dipole antenna element 2 is shown in more detail in FIG. 2A, and the second dipole antenna element 3 is shown in FIG. 2B. Both dipole antenna elements 2, 3 are aligned perpendicular to each other.

Figure 3B:
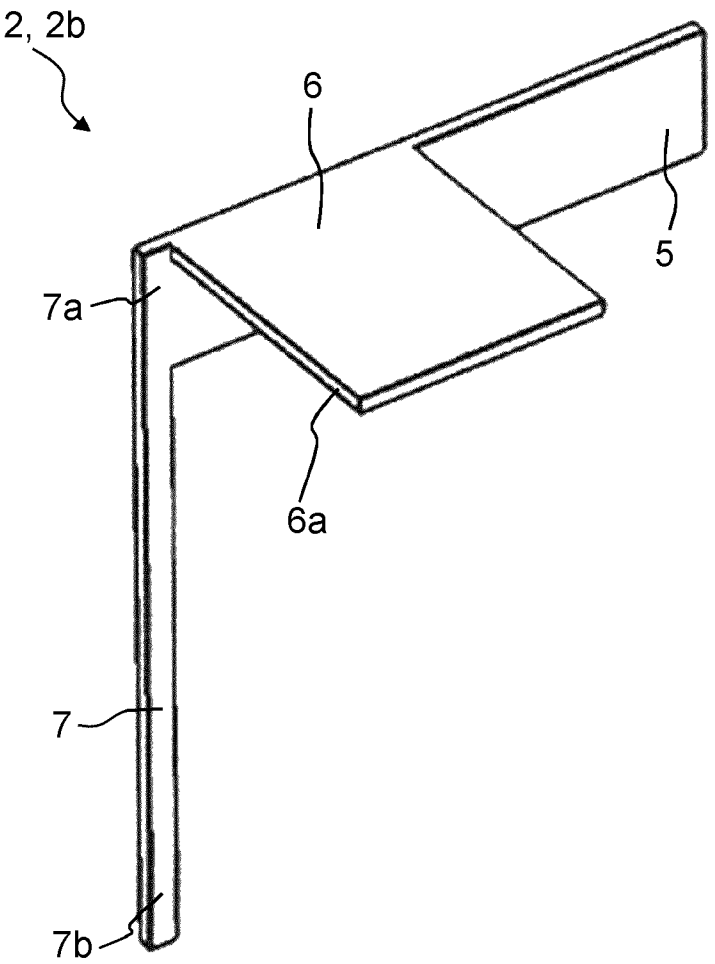
FIGS. 3A, 3B, 3C, 3D: the first and second dipole halves of the first dipole antenna element and the second dipole antenna element of the dual-polarised turnstile antenna.
Figure 3A:
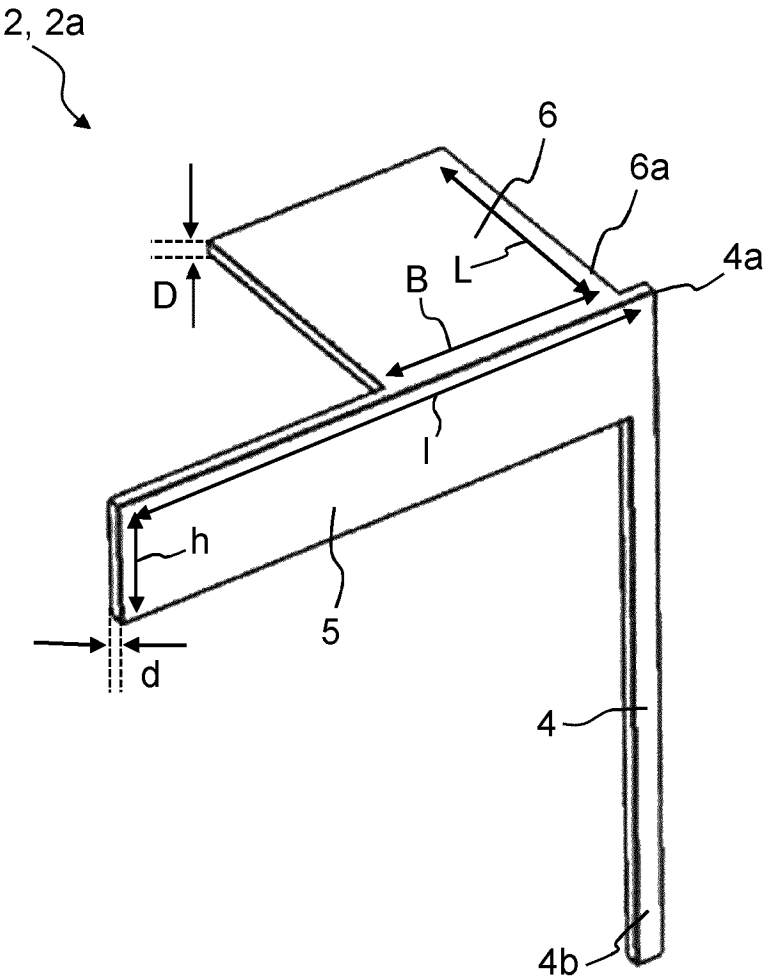
Figure 3D:
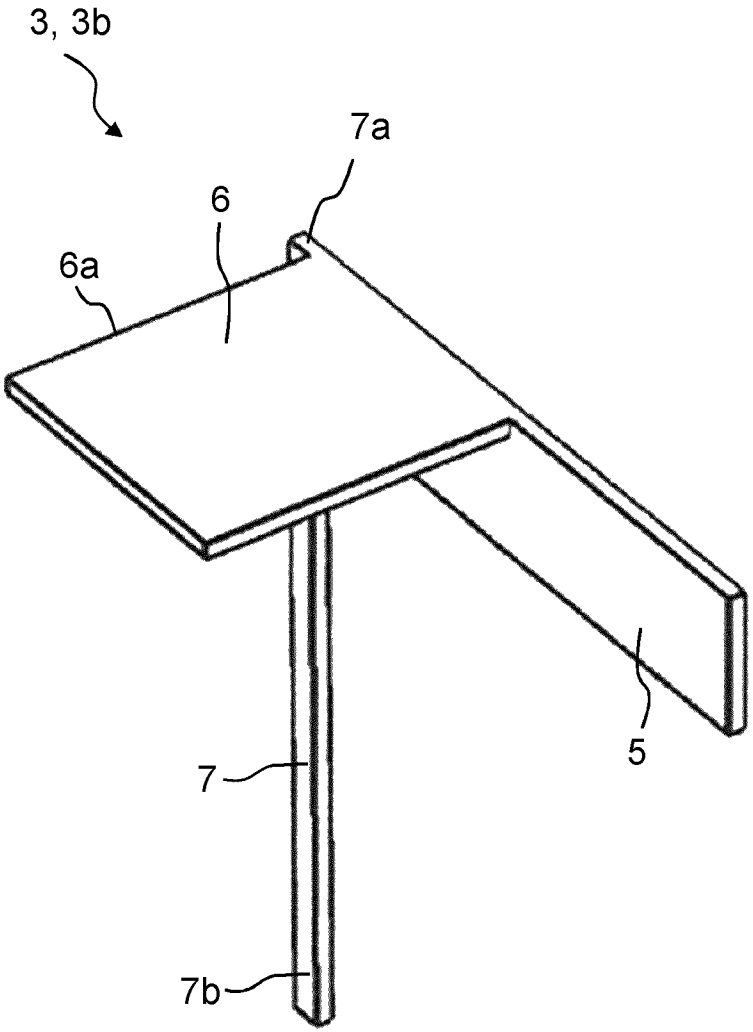
Figure 3C:
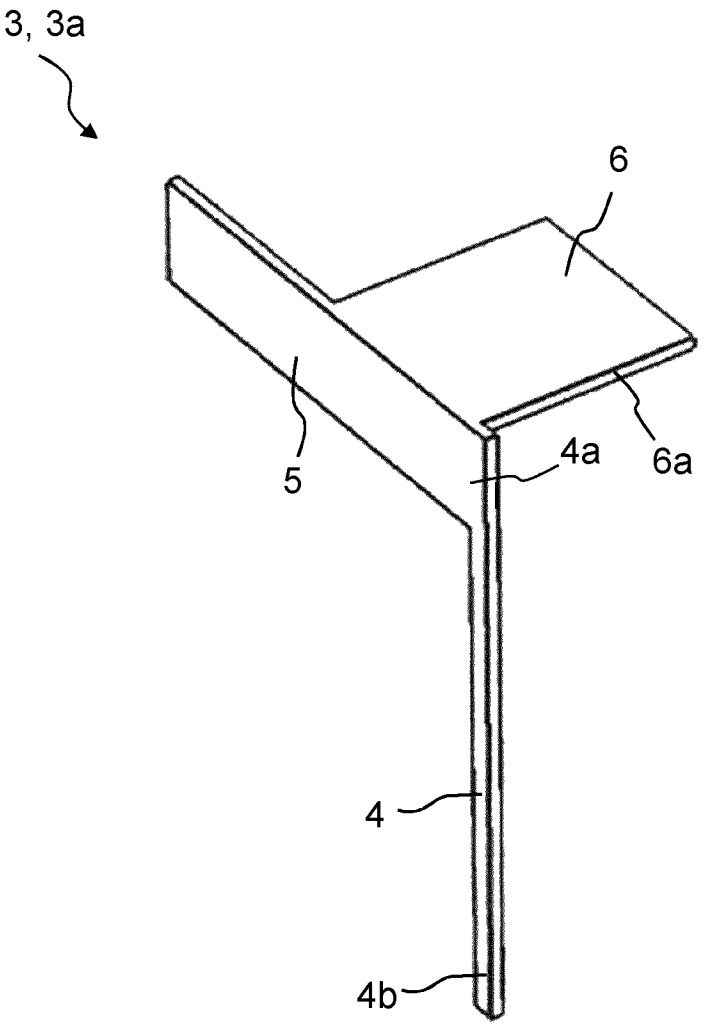

The first dipole antenna element 2 comprises two dipole halves 2*a*, 2*b*, which are shown enlarged in FIGS. 3A and 3B. Likewise, the second dipole antenna element 3 comprises two dipole halves 3*a*, 3*b*, which are shown in more detail in FIGS. 3C and 3D.

The first dipole half 2*a* of the first dipole antenna element 2 comprises a ground connection medium 4, a dipole section 5, and a coupling section 6. The dipole section 5 and the coupling section 6 are galvanically connected to one another and to a first end 4*a* of the ground connection medium 4. The first end 4*a* lies opposite a second end 4*b*, which is arranged on the reflector arrangement 101. The ground connection medium 4 is preferably electrically connected to the reflector arrangement 101.

The second dipole half 2*b* of the first dipole antenna element 2 comprises a signal connection medium 7, a dipole section 5, and a coupling section 6. The dipole section 5 and the coupling section 6 are in turn galvanically connected to one another and to a first end 7*a* of the signal connection medium 7. Likewise, a second end 7*b* of the signal connection medium 7, which lies opposite the first end 7*a*, is arranged on the reflector arrangement 101, but is not galvanically connected to it.

The same applies to the second dipole antenna element 3. The first dipole half 3*a* of the second dipole antenna element 3 comprises a ground connection medium 4, a dipole section 5, and a coupling section 6. The dipole section 5 and the coupling section 6 are galvanically connected to one another and to a first end 4*a* of the ground connection medium 4. A second end 4*b* of the ground connection medium 4, which lies opposite the first end 4*a*, is arranged on the reflector arrangement 101.

The second dipole half 3*b* of the second dipole antenna element 3 comprises a signal connection medium 7, a dipole section 5 and a coupling section 6. The dipole section 5 and the coupling section 6 are galvanically connected to one another and to a first end 7*a* of the signal connection medium 7. A second end 7*b* of the signal connection medium 7, which lies opposite the first end 7*a*, is in turn arranged on the reflector arrangement 101 but is not galvanically connected to it.

In this exemplary embodiment, the signal connection medium 7 of the first dipole antenna element 2 runs parallel to the ground connection medium 4 of the first dipole antenna element 2 or predominantly parallel to a component that is parallel to said ground connection medium. The same also applies to the signal connection medium 7 of the second dipole antenna element 3, which likewise runs parallel to the ground connection medium 4 of the second dipole antenna element 2 or predominantly parallel to a component that is parallel to said ground connection medium 4.

The dipole sections 5 of the first dipole antenna element 2 run in opposite directions. They can run through the same plane or through two planes that are arranged parallel to each other. In the latter case, the dipole sections 5 would be offset from one another. The same also applies to the dipole sections 5 of the second dipole antenna element 3, which likewise run in opposite directions.

In a preferred embodiment, the signal connection medium 7 of the first dipole antenna element 2 is galvanically connected to a first feed system (not shown). The same can also apply to the signal connection medium 7 of the second dipole antenna element 3. In this case, the signal connection mediums 7 would not be capacitively connected to the feed system.

In order to increase the broadband capability, the coupling sections 6 of the first dipole antenna element 2 each extend along the closest dipole section 5 of the adjacent second dipole antenna element 3. A spacing gap 8 is formed between a coupling side 6*a* of the respective coupling section 6 of the first dipole antenna element 2 and the respective adjacent dipole section 5 of the second dipole antenna element 3, as a result of which a capacitive coupling occurs between the coupling side 6*a* of the respective coupling section 6 of the first dipole antenna element 2 and the respective adjacent dipole section 5 of the second dipole antenna element 3.

In FIG. 1, the coupling section 6 of the first dipole half 2*a* of the first dipole antenna element 2 is coupled to the dipole section 5 of the first dipole half 3*a* of the second dipole antenna element 3. The coupling section 6 of the second dipole half 2*b* of the first dipole antenna element 2 is coupled to the dipole section 5 of the second dipole half 3*b* of the second dipole antenna element 3.

This also applies to the coupling sections 6 of the second dipole antenna element 3, which also extend along to the closest dipole section 5 of the adjacent first dipole antenna element 2. Between a coupling side 6*a* of the respective coupling section 6 of the second dipole antenna element 3 and the respective adjacent dipole section 5 of the first dipole antenna element 2, a spacing gap 8 is formed once again, as a result of which a capacitive coupling occurs between the coupling side 6*a* of the respective coupling section 6 of the second dipole antenna element 3 to the adjacent one Dipole section 5 of the first dipole antenna element 2.

In FIG. 1, the coupling section 6 of the first dipole half 3*a* of the second dipole antenna element 3 is coupled to the dipole section 5 of the second dipole half 2*a* of the first dipole antenna element 2. The coupling section 6 of the second dipole half 3*b* of the second dipole antenna element 3 is coupled to the dipole section 5 of the first dipole half 2*a* of the first dipole antenna element 2.

FIG. 1 also shows that the coupling sections 6 are rectangular. This also applies to dipole section 5. In principle, it would also be possible that this apply only to one or more but not to all of the coupling sections 6 and/or dipole sections 5.

The coupling sections 6 originate from the first end 4*a* of the respective ground connection medium 4 or from the first end 7*a* of the respective signal connection medium 7 of the second dipole half 2*a*, 2*b*, 3*a*, 3*b*. It would also be possible for the coupling sections 6 to originate from the respective dipole sections 5 of the second dipole half 2*a*, 2*b*, 3*a*, 3*b*.

In this exemplary embodiment, the coupling sections 6 are aligned parallel to the reflector arrangement 101. The dipole sections 5 are aligned perpendicular to the reflector arrangement 101. The angle between the coupling section 6 and the dipole section 5, to which it is galvanically connected, is preferably approximately 90°. The word "approximately" is to be understood to mean that a deviation of less than +/−5°, +/−3°, or less than +/−2° is included.

In FIG. 1, the height of the coupling sections 6 with which they protrude beyond reflector arrangement 101 is the same as the height of the respective dipole section 5 of the same dipole half 2*a*, 2*b*, 3*a*, 3*b*. This means that the coupling sections 6 do not protrude any further beyond the reflector arrangement 101 than the respective dipole section 5.

Referring to FIGS. 3A to 3D, it can be seen that the first dipole half 2*a* of the first dipole antenna element 2 is formed as one piece, which is pressed and/or stamped and/or laser-cut. The same also applies to the second dipole half 2*b* of the first dipole antenna element 2. The first dipole half 3*a* of the second dipole antenna element 3 is also formed as one piece, which is pressed and/or stamped and/or laser-cut. The same also applies to the second dipole half 3*b* of the second dipole antenna element 3.

Figure 5A:
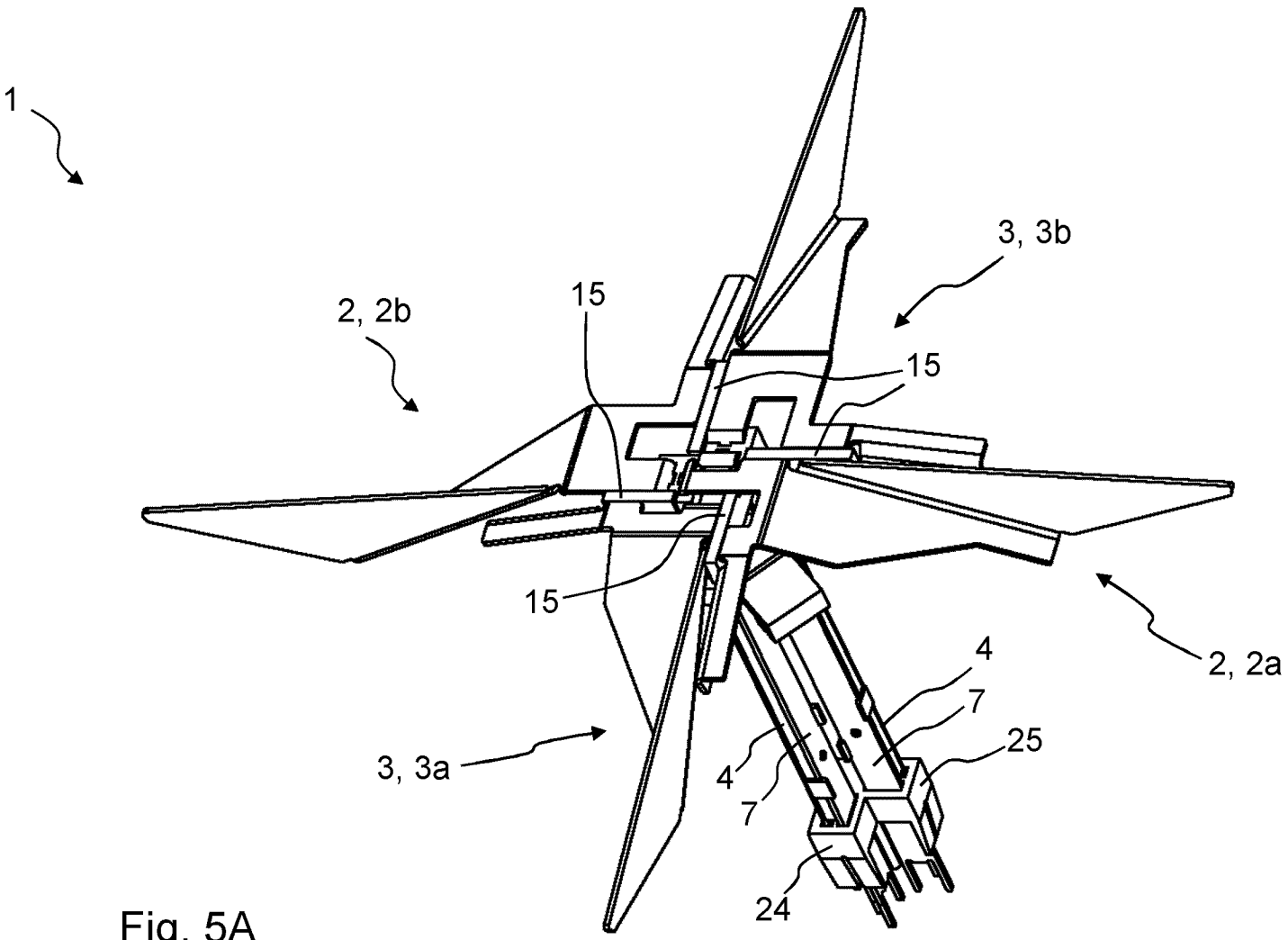
FIG. 5A: a further embodiment of the turnstile antenna according to the invention.
Figure 5B:
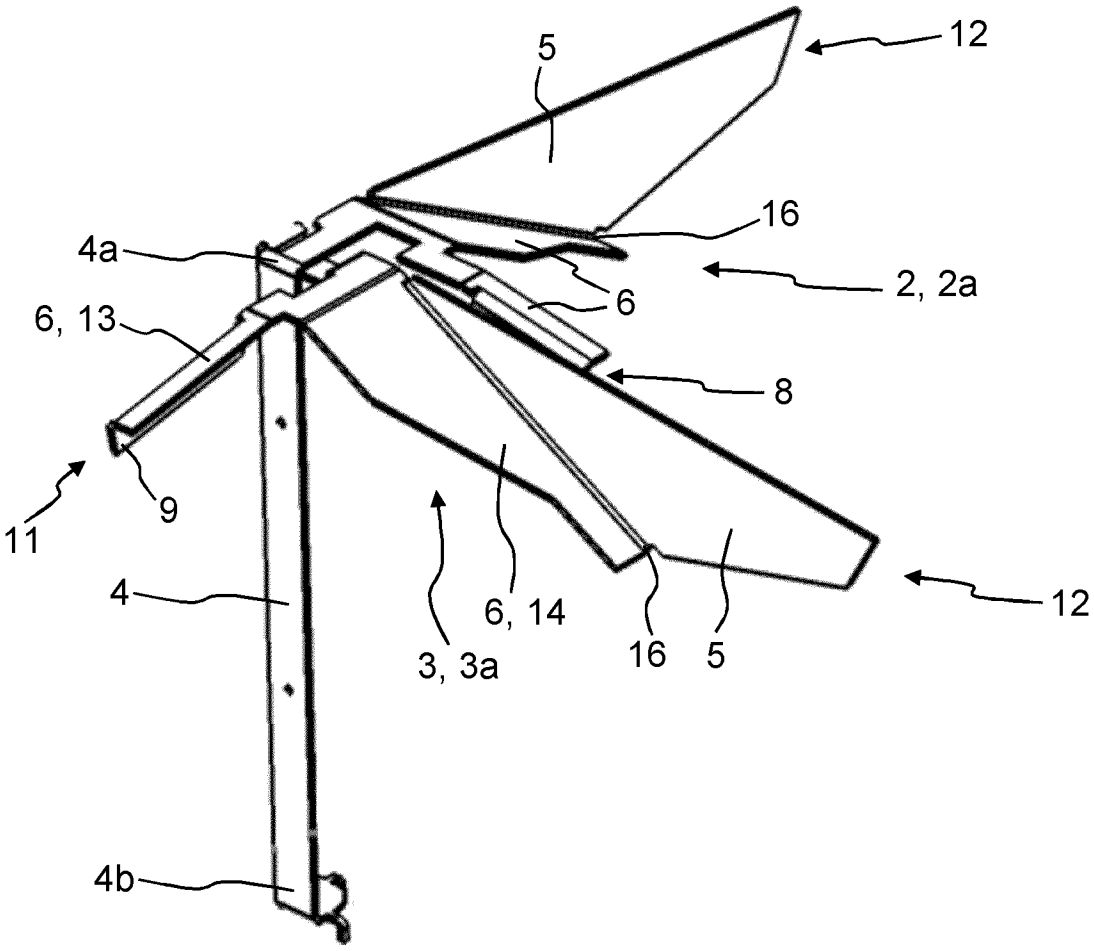
FIG. 5B: an embodiment that describes the one-piece design of two dipole halves of different dipole antenna elements.

In principle, as shown in FIG. 5B, it would also be possible for the first dipole half 2*a* of the first dipole antenna element 2 and the first dipole half 3*a* of the second dipole antenna element 3 to be formed in one piece, in particular as one piece, which is pressed and/or stamped and/or laser-cut. The dipole section 5 and the coupling section 6 of the first dipole half 2*a* of the first dipole antenna element 2 and the dipole section 5 and the coupling section 6 of the first dipole half 3*a* of the second dipole antenna element 3 are then galvanically connected to the first end 4*a* of a common ground connection medium 4.

In order to be able to achieve particularly good results with regard to the bandwidth in which the dual-polarised turnstile antenna 1 according to the invention can be used, it is advantageous if at least one coupling section 6 or all of the sections 6 have the same circumferential length or resonance length as the dipole section 5 of the corresponding own dipole half 2*a*, 2*b*, 3*a*, 3*b* to which the respective coupling section 6 belongs.

With regard to FIG. 3A, an important dimensioning that is necessary to achieve particularly good results is explained once again. The dipole section 5 extends a length l away from the first end 4*a* of the ground connection medium 4 and has a height h and a thickness d. The height h is greater than the thickness d. The associated coupling section 6 runs via a length L from the first end 4*a* of the ground connection medium 4 or from the dipole section 5 of the same dipole half 2*a*, 2*b*, 3*a*, 3*b* and along the closest dipole section 2*a*, 2*b*, 3*a*, 3*b* of the other dipole antenna element 2, 3. The coupling section 6 also has a width B along which it extends to the dipole section 5 of its own dipole half 2*a*, 2*b*, 3*a*, 3*b*. It also has a thickness D, the length L and the width B being greater than the thickness D. The difference between a first sum of length l and height h of the dipole section 5 and a second sum of length L and width B of that coupling section 6, which is galvanically connected to the dipole section 5, is less than 30%, 25%, 20%, 15%, 10%, or less than 5% of the first or second sum.

This dimensioning preferably applies to all dipole halves 2*a*, 2*b*, 3*a* and 3*b* as shown in FIGS. 3A to 3D.

At least one coupling section 6 is electrically connected over its entire width B to the respective dipole section 5 of the same dipole half 2*a*, 2*b*, 3*a*, 3*b*. In particular, however, only the portion on which the coupling section 6 is galvanically connected to the dipole section 5 belongs to the width B.

The length L of at least one coupling section 6 is preferably the length l of the closest dipole section 5 of the other dipole antenna element 2, 3 along which the respective coupling section 6 extends. This means that the corresponding coupling section 6 does not protrude beyond the closest dipole section 5 of the other dipole antenna element 2, 3. The same preferably also applies to the width B. The width B of at least one coupling section 6 is preferably smaller than the length l of the dipole section 5 of the same dipole half 2*a*, 2*b*, 3*a*, 3*b*.

Figure 4B:
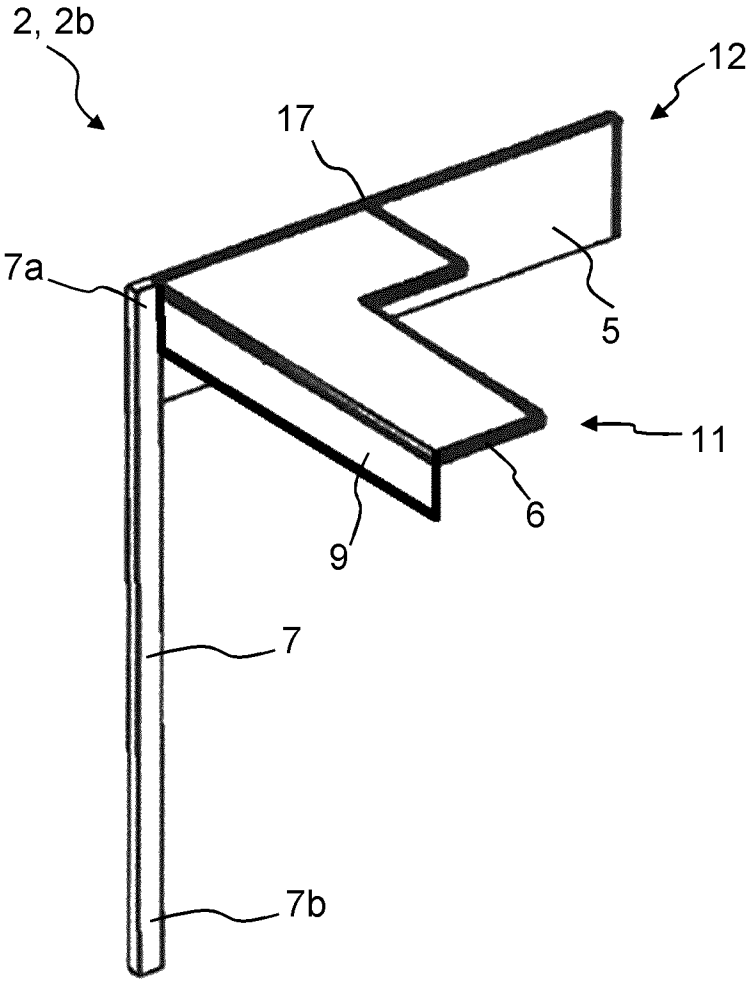
FIGS. 4A, 4B, 4C, 4D, 4E, 4F, 4G, 4H, 4I: various embodiments of a dipole half.
Figure 4A:
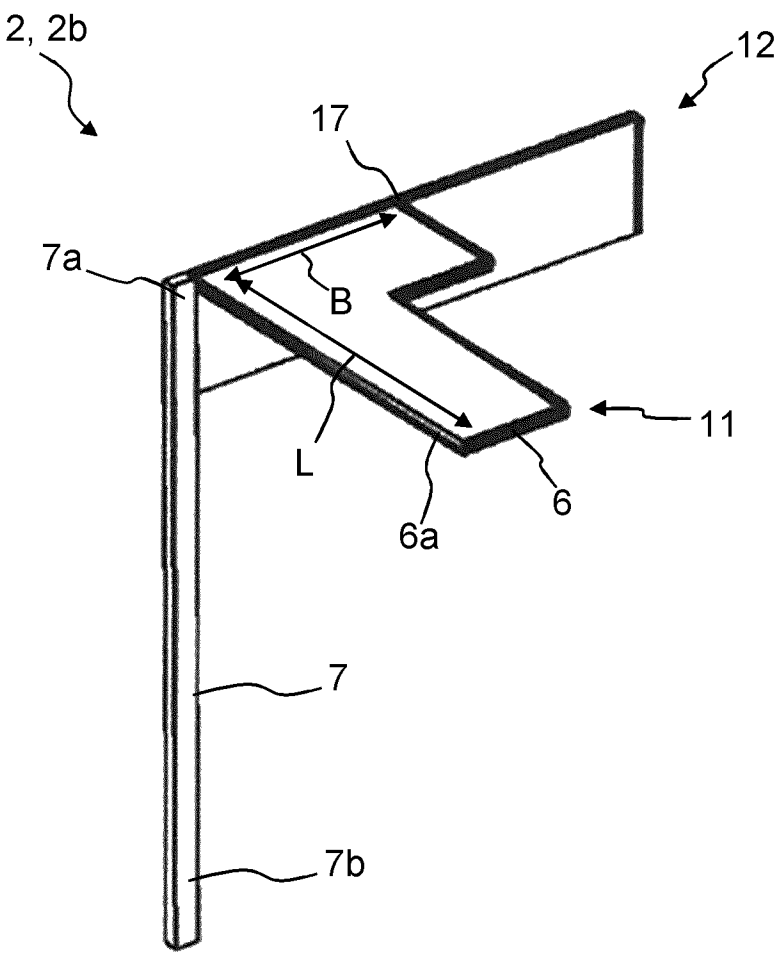

FIGS. 4A and 4B show a further exemplary embodiment of the second dipole half 2*b* of the first dipole antenna element 2. It is clear that the other dipole halves 2*a*, 3*a*, 3*b* could also be constructed accordingly. The coupling section 6 comprises an L-shape in this case. It tapers away from the dipole section 5. This taper is stepped. As seen from above, the at least one coupling section 6 extends the farthest away from the dipole section 5 of the same dipole half 2*a*, 2*b*, 3*a*, 3*b* on the coupling side 6*a* which runs adjacent to the dipole section 5 of the other dipole antenna element 2, 3, in which case this extent (away from dipole section 5 of the same dipole half 2*a*, 2*b*, 3*a*, 3*b*) decreases in a stepped manner as the width B (i.e., in the direction of the free end 12 of dipole section 5) increases. It might also be possible for said extent to taper in a continuous manner.

In FIG. 4B, the coupling section 6 comprises a coupling lug 9, which is formed over the entire length L of the coupling section 6 on its coupling side 6*a* and is bent in the direction of the reflector arrangement 101. This increases the coupling area, which increases the coupling between the respective coupling section 6 and the respective adjacent dipole section 5 of the other dipole antenna element 2, 3. In principle, a bend away from the reflector arrangement 101, that is to say upward, might be possible as well. The coupling lug 9 could also be arranged only over a partial distance, i.e., not over the entire length L.

Figure 4D:
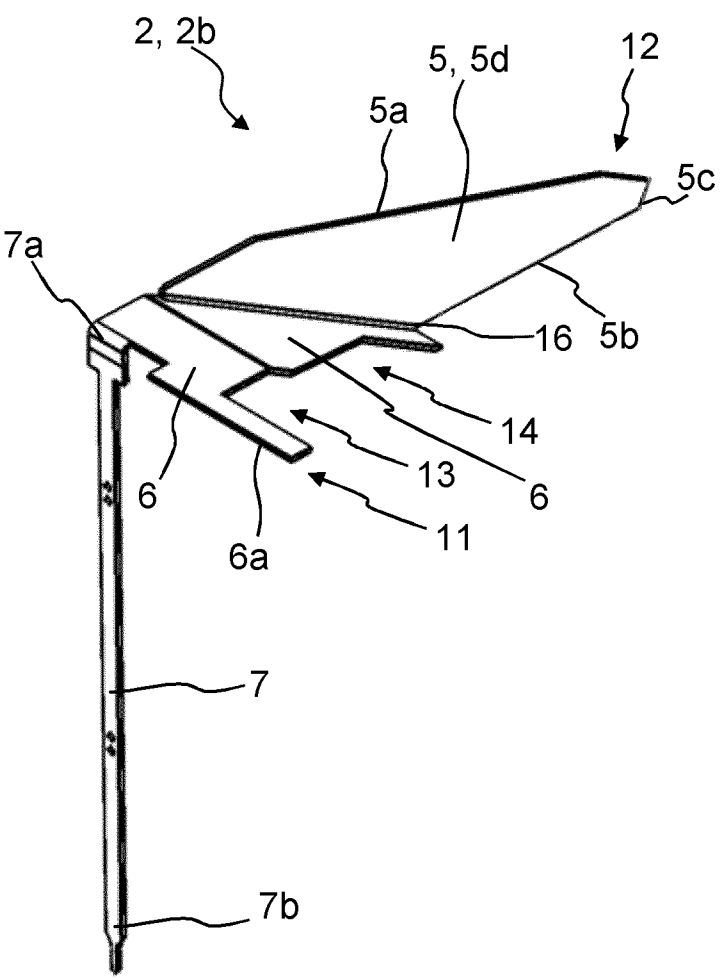
Figure 4C:
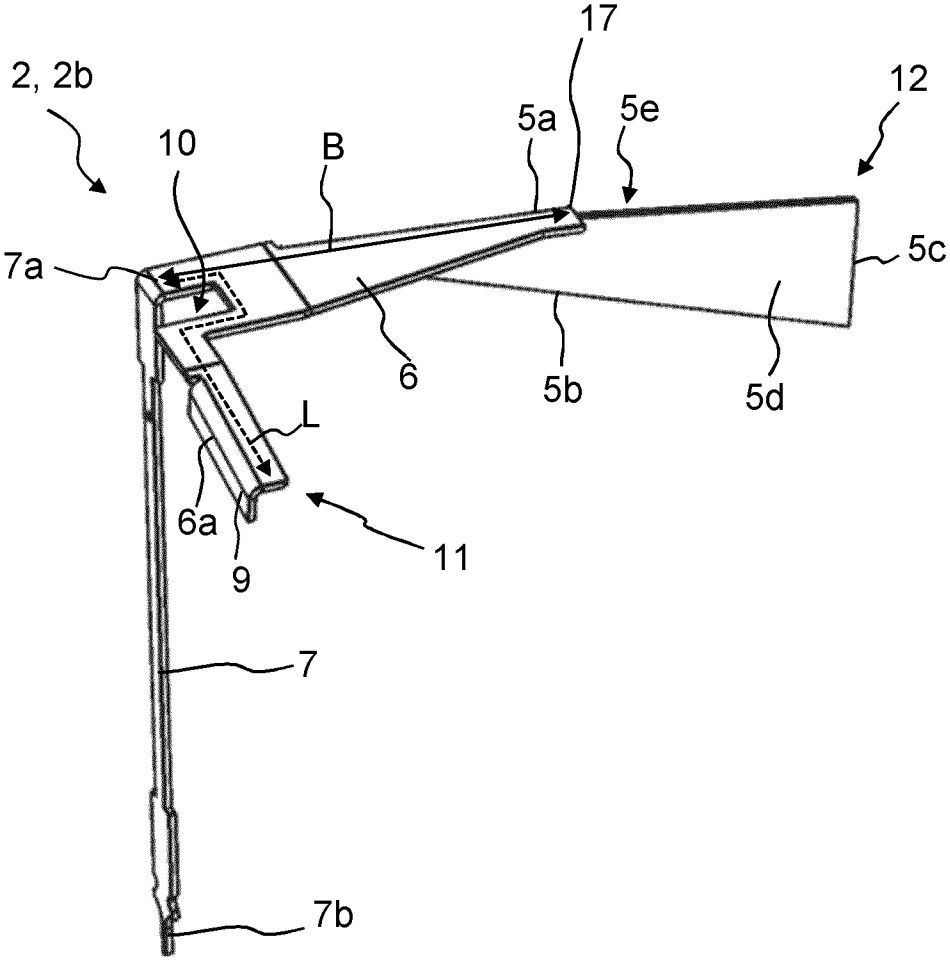
Figure 4F:
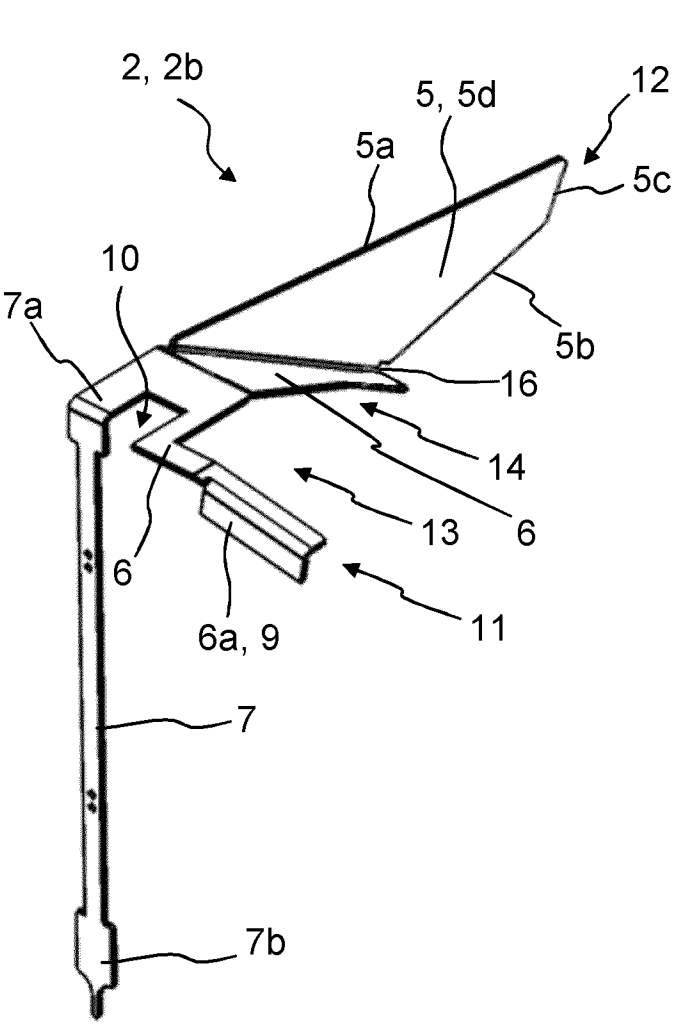
Figure 4E:
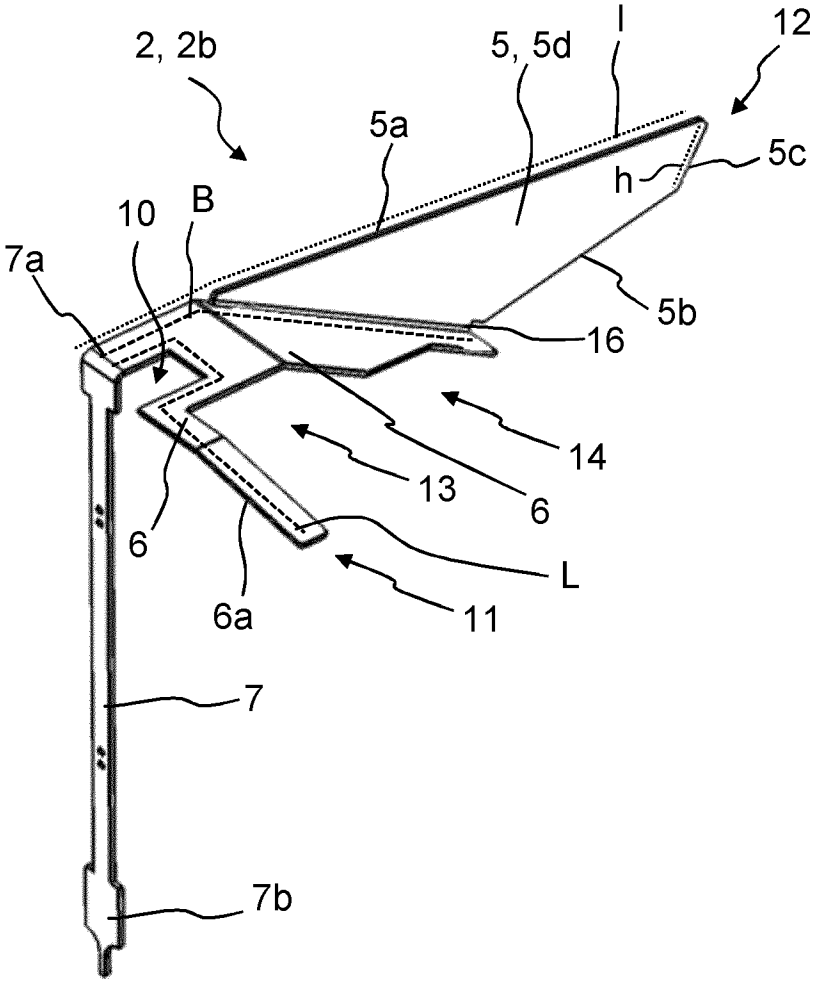
Figure 4H:
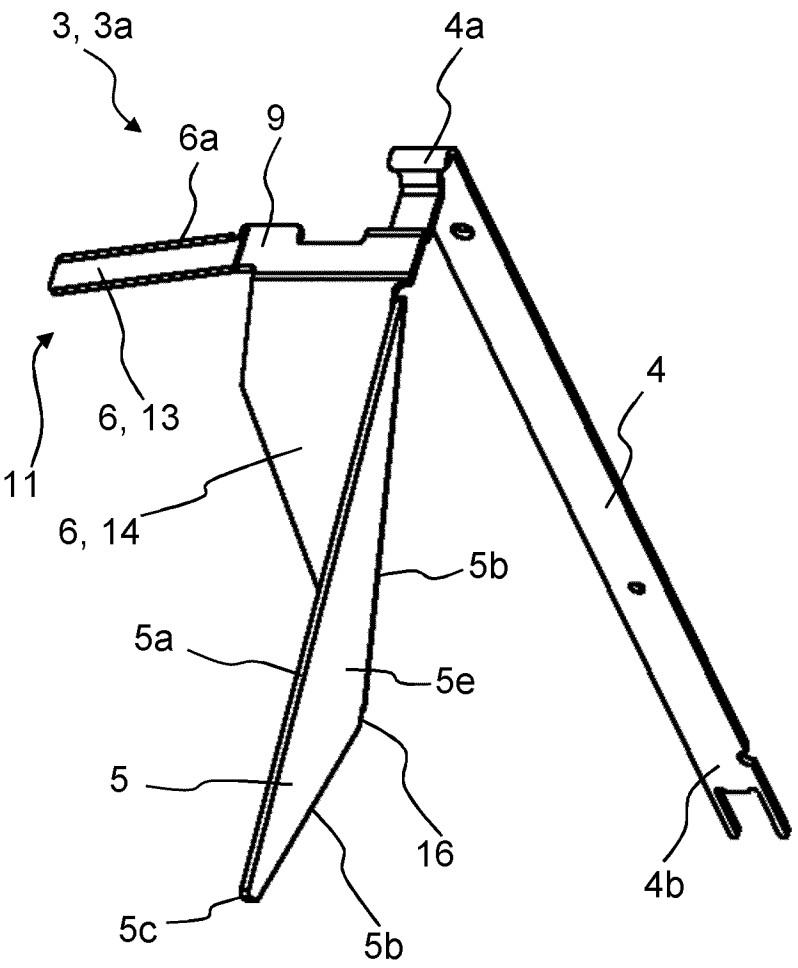
Figure 4G:
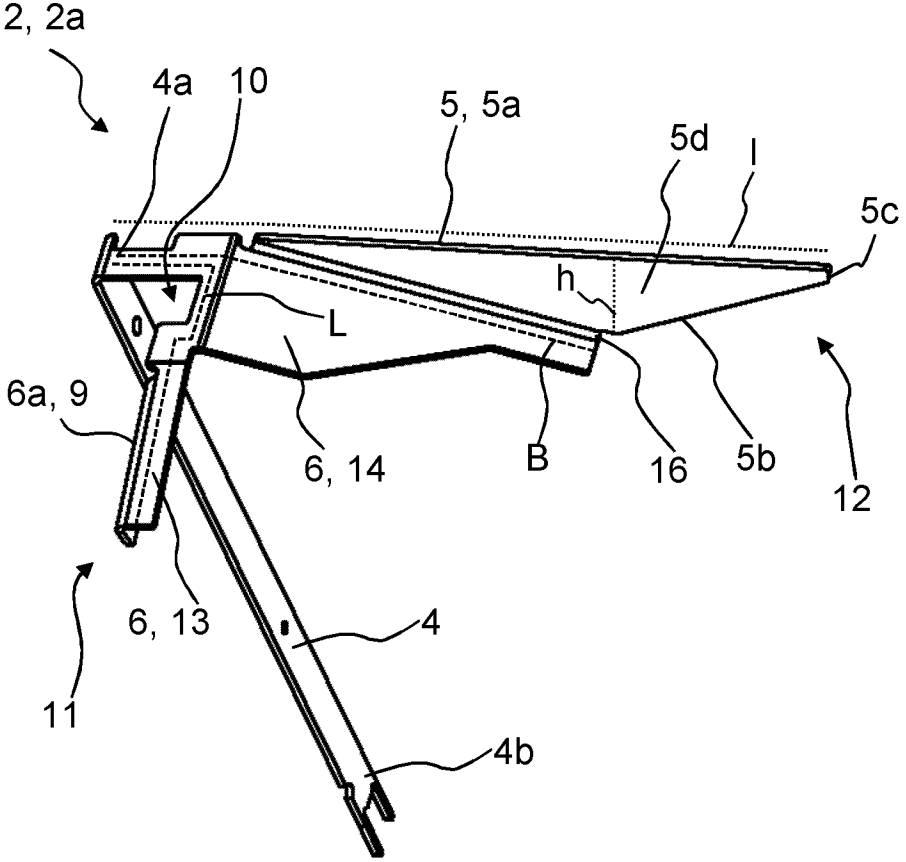

FIGS. 4C to 4H show a further exemplary embodiment of the dual-polarised turnstile antenna 1 according to the invention. In FIG. 4C, the coupling section 6 comprises a corresponding coupling lug 9, which is bent in the direction of the reflector arrangement 101. The coupling section 6 also comprises at least one indentation 10 which is formed on the coupling side 6*a* of the coupling section 6. As a result, the length L of the coupling section 6 is increased. This indentation 10 is accessible from the outside, i.e., when seen from the coupling side 6*a*. The coupling section 6 can have a meandering structure in this area.

The coupling section 6 is bent in the direction of the reflector arrangement 101 in the area of said section's open end 11, which is arranged adjacent to the adjoining dipole section 5 of the other dipole antenna element 2, 3 and on which the coupling side 6*a* is formed. The coupling section could also be bent away from the reflector arrangement 101 or run parallel to it. The coupling lug 9 is in particular only arranged in the curved area of the coupling section 6.

The height by which the dipole section 5 protrudes from the reflector arrangement 101 decreases towards the free end 12 of the dipole section 5. This means that the dipole section 5 is inclined over its entire length l or, as shown in FIG. 4C, only over a partial length. This inclination, in particular in the direction of the reflector arrangement 101, is selected such that the shape of the dipole section 5 corresponds to a respective shape of a housing cover, which is not shown.

The dipole section 5 comprises at least a top surface 5*a*, a bottom surface 5*b*, an end surface 5*c*, and side surfaces 5*d*, 5*e*. In this case, the top surface 5*a* runs from the first end 7*a* of the signal connection medium 7 over a partial length both parallel to the reflector arrangement 101 and over a subsequent partial length inclined in the direction of the reflector arrangement 101. It could also run only parallel to the reflector arrangement 101 or be only inclined towards the reflector arrangement 101. The bottom surface 5*b* extends from the first end 7*a* of the signal connection medium 7, inclined in the direction of the reflector arrangement 101, to the end surface 5*c*. In this case, the bottom surface 5*b* is inclined more in the direction of the reflector arrangement 101 than the top surface 5*a*, as a result of which the height of the first and second side surfaces 5*d*, 5*e* is greater in the area of the end surface 5*c* than in the area of the signal connection medium 7. This height (the maximum height) is particularly relevant for dimensioning purposes.

The corresponding coupling section 6, which is galvanically connected to the dipole section 5 along the width B, extends over a partial length (width B) of the top surface 5*a* along the top surface 5*a* and ends at an end area 17 that is at a distance from the end surface. The coupling section 6 is generally not inclined up to this end area 17 and preferably runs parallel to the reflector arrangement 101.

An extent of the coupling section 6 away from the dipole section 5 increases from the end area 17 to the open end 11 of the coupling section 6 at the closest dipole section 5 of the adjacent dipole antenna element 2, 3 in a stepped and/or continuous manner.

FIG. 4D shows a somewhat different structure. In FIG. 4D, the top surface 5*a* is inclined to the reflector arrangement 101 in the direction of the end surface 5*c*. The top surface 5*a* in this case comprises various segments which run at an angle to one another, that is to say inclined, until it finally reaches the end surface 5*c*. The bottom surface 5*b* could run as shown in FIG. 4C. In FIG. 4D, however, the bottom surface is inclined from the first end 7*a* of the signal connection medium 7 in the direction of the reflector arrangement 101 until it reaches a turning point 16, in order then to rise in the further course while increasing the distance from the reflector arrangement 101, as a result of which the height of the first and second side surface 5*d*, 5*e* of the dipole section 5 is larger in the area of the turning point (16) than in the area of the end surface 5*c* of the dipole section 5. The height of the dipole section 5 is preferably greatest in the area of the turning point 16. This height is preferably used for dimensioning purposes.

The corresponding coupling section 6 could also run as shown in FIG. 4C. In FIG. 4D, the coupling section 6, however, comprises a first area 13 and a second area 14. In the first area 13, the coupling section 6 runs approximately parallel to the reflector arrangement 101. In the first area, it also comprises the coupling side 6*a*. The first area 13 then transitions into a second area 14, in which the coupling section 6 runs, starting from the top surface 5*a* of the dipole section 5 via the first side surface 5*d* of the dipole section 5 to the bottom surface 5*b*, in particular to the turning point 16 on the bottom surface 5*b* of the dipole section 5. The second area 14 is thus partially or completely inclined in the direction of the reflector arrangement 101.

In the second area 14, the coupling section 6 tapers as well, starting from the first area 13 in the direction of the turning point. This tapering can take place in a stepped and/or continuous manner. This means that an extent of the coupling section 6 away from the dipole section 5 starting from the turning point 16 toward the open end 11 of the coupling section 6 at the closest dipole section 5 of the adjacent dipole antenna element 2, 3 increases in a stepped and/or continuous manner. The first area 13 also tapers from the open end 11 in the direction of the second area 14. In this case, the tapering is stepped. The tapering could also be continuous.

In FIG. 4D, the top surface 5*a* and the bottom surface 5*b* run towards one another in the direction of the free end 12 of the dipole section 5 and form a tip, which is part of the end surface 5*c*.

In FIGS. 4E, 4F, 4G and 4H, the end surface 5*c* is inclined with respect to the reflector arrangement 101, the inclination occurring in the direction of the second end 7*b*, 4*b* of the signal connection medium 7 or the ground connection medium 4.

Furthermore, FIGS. 4E, 4F, 4G and 4H show different configurations with recesses 10 of different sizes, the use of a coupling lug 9 and the bending of the open end 11 on which the coupling lug 9 is formed.

The features described with regard to the coupling section 6 and the dipole section 5 apply to each dipole half 2*a*, 2*b*, 2*c*, 2*d*. All of these coupling sections 6 or dipole sections 5 may or may not have the same configuration.

The structure shown in FIGS. 4D to 4H represents a particularly preferred variant. It is different because of the feature that the corresponding coupling section 6 in the second area 14 extends from the top surface 5*a* of the dipole section 5 via the first side surface 5*d* of the dipole section 5 to the turning point 16 on the bottom surface 5*b* of the dipole section 5 and is therefore inclined in the direction of the reflector assembly 101. The currents running on the top surface 5*a* are thus spaced from the second portion 14 of the coupling sections 6 and are better separated. This applies to both dipole halves 2*a*, 2*b*, 3*a*, 3*b* of two dipole antenna elements 2, 3. This leads to very good emission characteristics as well as very good decoupling and compact emitter impedances at the base points of the antenna elements.

FIG. 41 shows another embodiment of a first dipole half 2*a* of the first dipole antenna element. The dipole section 5 comprises at least a top surface 5*a*, a bottom surface 5*b*, an end surface 5*c*, and the side surfaces 5*d*, 5*e*. In this case, the top surface 5*a* extends approximately parallel from the first end 4*a* of the ground connection medium 4 to the reflector arrangement 101. It could also be inclined to the reflector arrangement 101. The bottom surface 5*b* originates from below the first end 4*a* of the ground connection medium 4 and extends in an inclined manner in the direction of the reflector arrangement 101 over at least a first partial length. Over a subsequent second partial length, the bottom surface 5*b* preferably runs parallel to the reflector arrangement 101 until the end surface 5*c*. The transition from the first partial length to the second partial length can take place in a leaping manner, as it is possible for a dipole half 2*a* in FIG. 4J. The transition could also be continuous. At least part of the progression of the bottom surface 5*b* could, for example, be curved or semicircular. Basically, it can be said that the bottom surface 5*b* has a stepped and/or continuous taper in the direction of the reflector arrangement 101. The turning point 16 can then be at this point. The progression of the floor surface would preferably be described by a curvature or a partial circle. The first partial length is longer than the second partial length. This could also be the other way around. Both partial lengths could also be the same length.

Figure 4J:
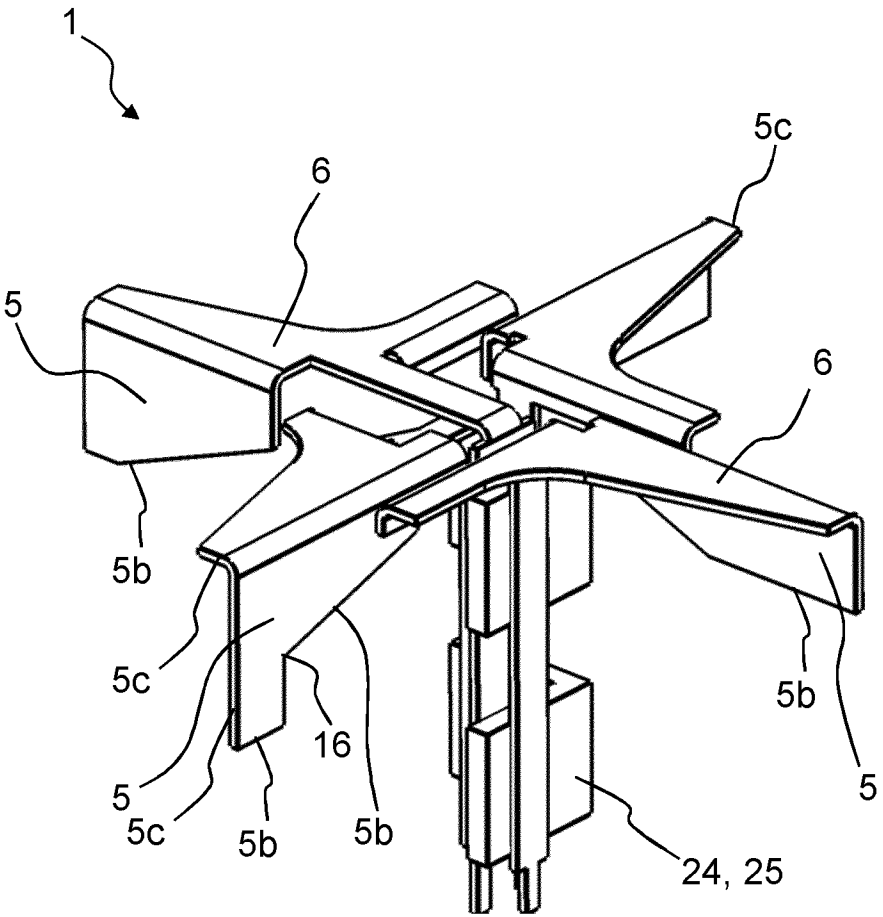
FIG. 4J: a further embodiment of the turnstile antenna according to the invention.
Figure 4I:
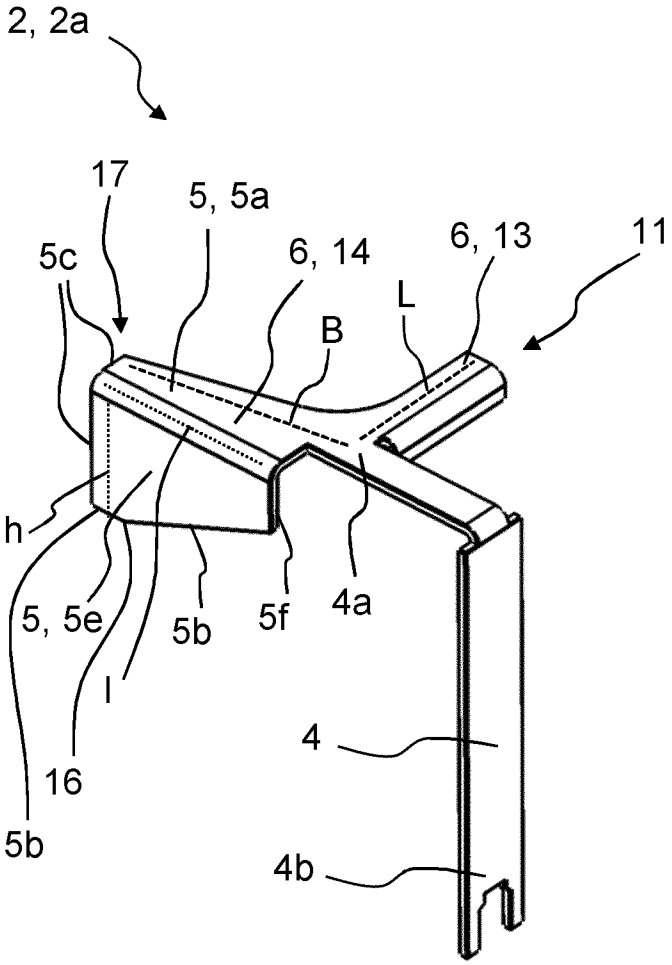

A second end surface 5*f* is arranged between the area of the bottom surface 5*b* which is next to the first end 4*a* of the ground connection medium 4 and the first end 4*a* of the ground connection medium 4. The bottom surface 5*b* therefore begins at a distance from the top surface 5*a* (by the length of the end surface 50 in the direction of the reflector arrangement 101. The bottom surface 5*b* of the dipole section 5 therefore runs (around the second end surface 5*f* in the direction of the reflector arrangement 101) offset from the first end 4*a* or 7*a* of the ground connection medium 4 or signal connection medium 7 in the direction of the end surface 5*c*. In FIGS. 41 and 4J, the ground connection medium 4 extends over a greater length (preferably less than 5 cm, 4 cm, 3 cm, 2 cm, 1 cm, but preferably more than 1.5 cm, 2.5 cm, 3.5 cm or 4.5 cm) in the area of its first end 4*a* approximately parallel to the reflector arrangement 101 than in the previous exemplary embodiments. The dipole section 5 and the coupling section 6 are arranged at the first end 4*a* of the ground connection medium 4.

The corresponding coupling section 6, which is galvanically connected to the dipole section 5 along the width B, runs along the top surface 5*a* and ends at the end surface 5*a* at the end area 17. Said coupling section could also end before the end area 17. The coupling section 6 is preferably not inclined up to this end area 17 and in particular runs parallel to the reflector arrangement 101.

An extent of the coupling section 6 away from the dipole section 5 increases continuously from the end area 17 to the open end 11 of the coupling section 6 at the closest dipole section 5 of the adjacent dipole antenna element 2, 3. The extent of the coupling section 6 could also increase in a stepped manner.

In this exemplary embodiment, the length L of the at least one coupling section 6 or of all coupling sections 6 is smaller than its width B. The width B of at least one coupling section 6 or of all coupling sections 6 is greater than the length l of the dipole section 5 of the same dipole half 2*a*, 2*b*, 3*a*, 3*b*. This means that the top surface 5*a* of the dipole section 5 does not extend over the entire width B of the coupling section 6.

FIG. 4J shows a further exemplary embodiment of the turnstile antenna 1 according to the invention. Preferably, the progressions of the first and second partial lengths of the bottom surface 5*b* of two, three, or all four dipole halves 2*a*, 2*b*, 3*a*, 3*b* are different from one another. The progressions of the coupling sections 6 could also be different from one another with respect to two, three, or all four dipole halves 2*a*, 2*b*, 3*a*, 3*b*.

According to FIG. 5A, a first holding device 25 is provided, which comprises or consists of a dielectric material. The first holding device 25 is arranged between the ground connection medium 4 of the first dipole antenna element 2 and the signal connection medium 7 of the first dipole antenna element 2. Said holding device comprises a plurality of holding means, which are both in engagement with the ground connection medium 4 of the first dipole antenna element 2 and with the signal connection medium 7 of the first dipole antenna element 2 and prevent a displacement of the ground connection medium 4 and the signal connection medium 7 relative to one another. There is also a second holding device 26 which is arranged on the ground connection medium 4 and signal connection medium 7 of the second dipole antenna element 3 and which prevents a displacement of the ground connection medium 4 and the signal connection medium 7 of the second dipole antenna element 3 relative to one another. Both holding devices 25, 26 could also consist of a shared part.

A dielectric 15 is also shown, which is arranged in the spacing gap 8. In principle, such a dielectric 15 can be arranged in each spacing gap 8. This does not have to be the case, however. The dielectrics 15 can all be of the same length or of different lengths. The dielectrics 15 can also be arranged on or clipped onto the respective coupling lug 9.

It is also possible for the respective dielectric 15 to be an integral component of the respective holding device 25 or 26. The dielectric 15 is preferably made of a plastic such as Teflon.

It is also possible for the respective holding device 25, 26 to be formed by overmoulding the ground connection medium 4 and the signal connection medium 7 of the first dipole antenna element 2 and the second dipole antenna element 3, respectively.

FIG. 5B shows that the first dipole half 2*a* of the first dipole antenna element 2 and the first dipole half 3*a* of the second dipole antenna element 3 are formed in one piece. The dipole section 5 and the coupling section 6 of the first dipole half 2*a* of the first dipole antenna element 2 and the dipole section 5 and the coupling section 6 of the first dipole half 3*a* of the second dipole antenna element 3 are galvanically connected to one another and to the first end 4*a* of a shared ground connection medium 4.

Figure 6:
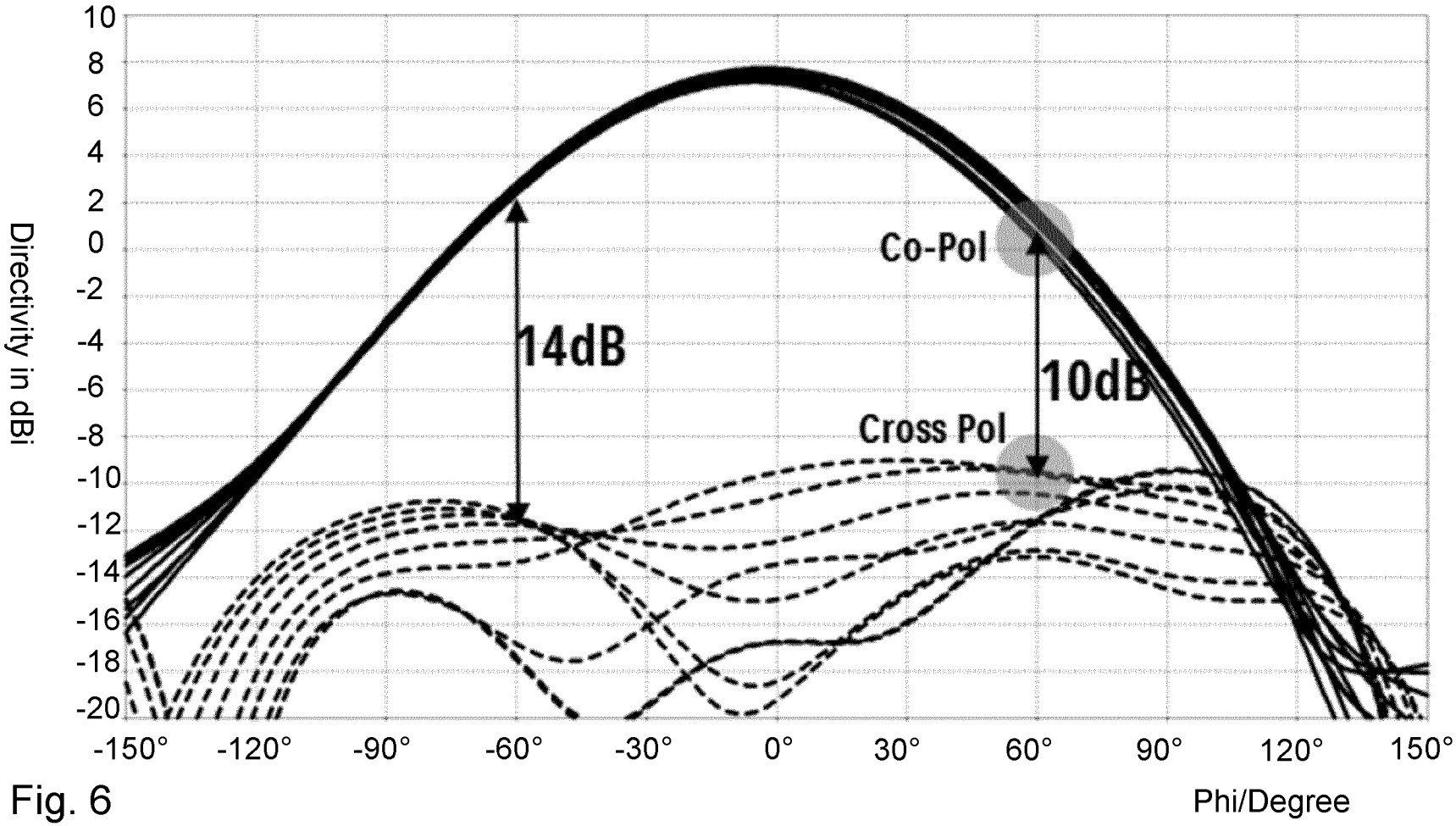
FIG. 6: a far field horizontal diagram which illustrates the electrical properties of the turnstile antenna according to the invention.

FIG. 6 shows a diagram which explains the advantageous electrical properties of the turnstile antenna 1 according to the invention in more detail. A far field horizontal polarisation diagram is shown, with theta=90°. The different curves represent different frequencies. The frequencies start at 698 MHz and go up to 960 MHz. The directivity in dBi and the radiation angle Phi are plotted as well.

Figure 7:
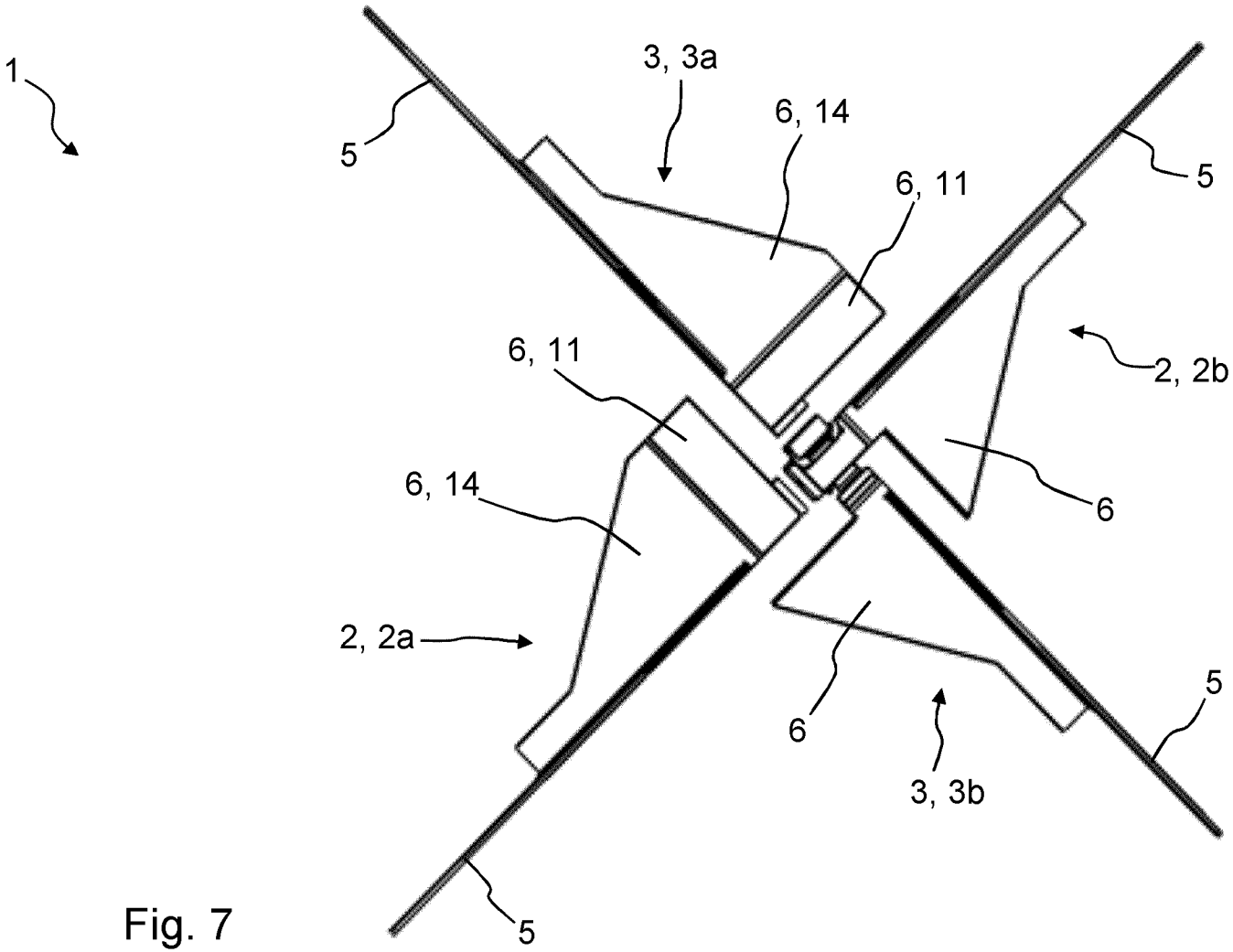
FIG. 7: a further embodiment of the turnstile antenna according to the invention.

FIG. 7 shows once again a top view of the dual-polarised turnstile antenna 1 according to the invention. It can be seen that the signal connection medium 7 of the second dipole antenna element 3 is bent at its first end 7*a* so that it extends approximately parallel to the reflector arrangement 101 and passes under the signal connection medium 7 of the first dipole antenna element 2, which is also bent at its first end 7*a*. The electrical phase centre and the mechanical (e.g. rotation/weight) centre are arranged at an offset from one another. This means that these centres penetrate different areas of the dual-polarised turnstile antenna 1. The first dipole antenna element 2 and the second dipole antenna element 3 each have their own electrical phase centre. Both electrical phase centres are arranged at an offset from one another. Very high installation values of at least −20 dB, −30 dB, −40 dB are achieved at the base of the turnstile antenna 1 with such a structure.

Figure 8:
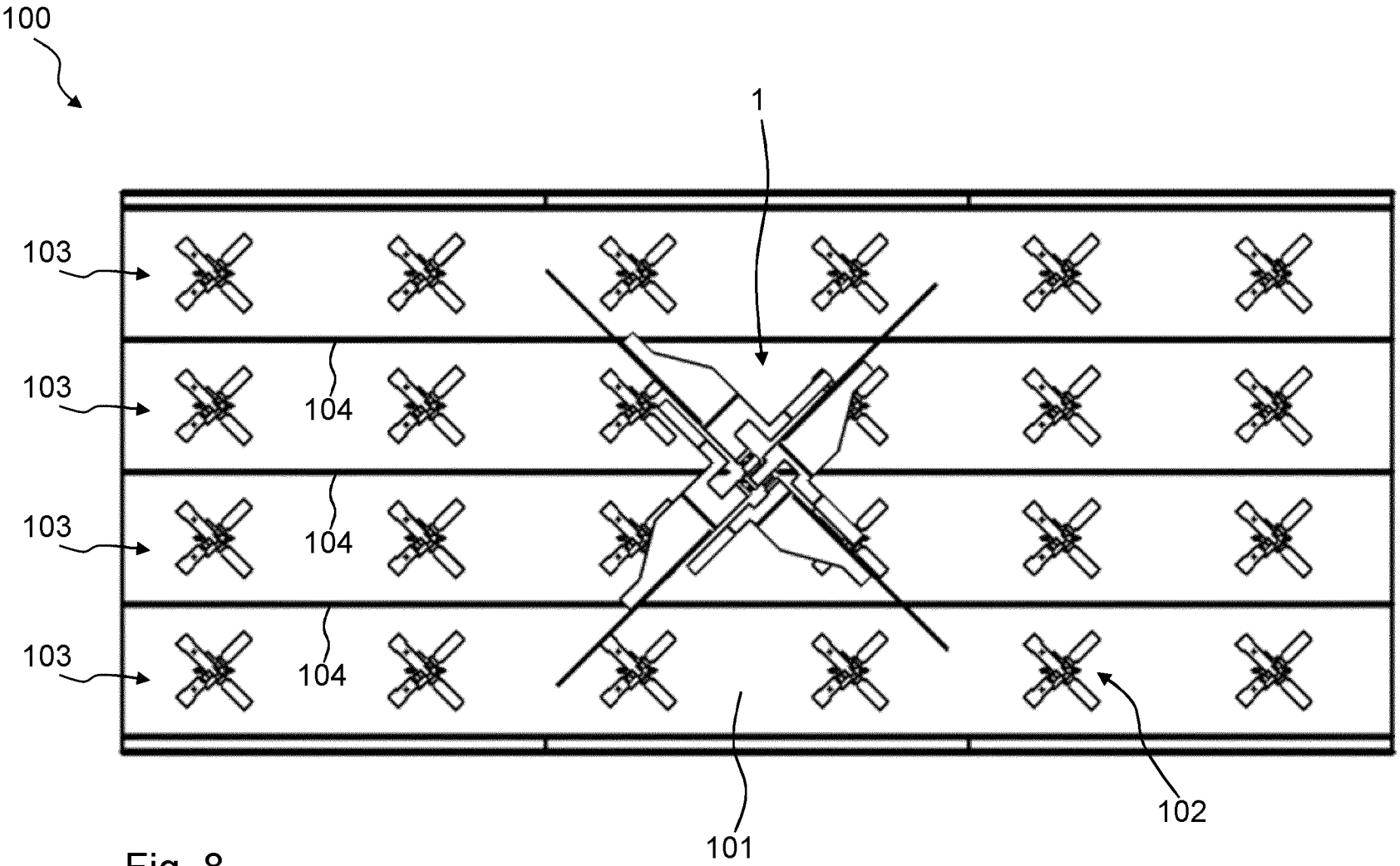
FIG. 8: a plan view of the antenna arrangement according to the invention with the turnstile antenna and other higher frequency turnstile antennas.

FIG. 8 shows the antenna arrangement 100 together with the reflector arrangement 101. There are also other higher-frequency turnstile antennas 102 that have smaller dimensions than the at least one dual-polarised turnstile antenna 1. The higher-frequency turnstile antennas 102 do not protrude from the reflector arrangement 101 as far as the at least one dual-polarised turnstile antenna 1. For this reason, it is possible that at least one higher-frequency turnstile antenna 102 is, when the antenna arrangement 100 seen from above, partially covered by the first or second dipole antenna element 2, 3 of the at least one dual-polarised turnstile antenna 1.

The emitter planes of the first and second dipole antenna elements 2, 3 of the dual-polarized turnstile antenna 1 preferably run parallel to the emitter planes of the first and second dipole antenna elements of the higher-frequency turnstile antennas 102.

A number of rows 103 are provided, in which the higher-frequency turnstile antennas 102 are arranged. The plurality of rows 103 are separated from one another by partition devices 104. These partition devices 104 can extend away from the reflector arrangement 101 and can be less high than or of the same height as the high-frequency turnstile antennas 102. As a result, high-frequency turnstile antennas 102 of different rows 103 are at least partially shielded or decoupled from one another.

Figure 9:
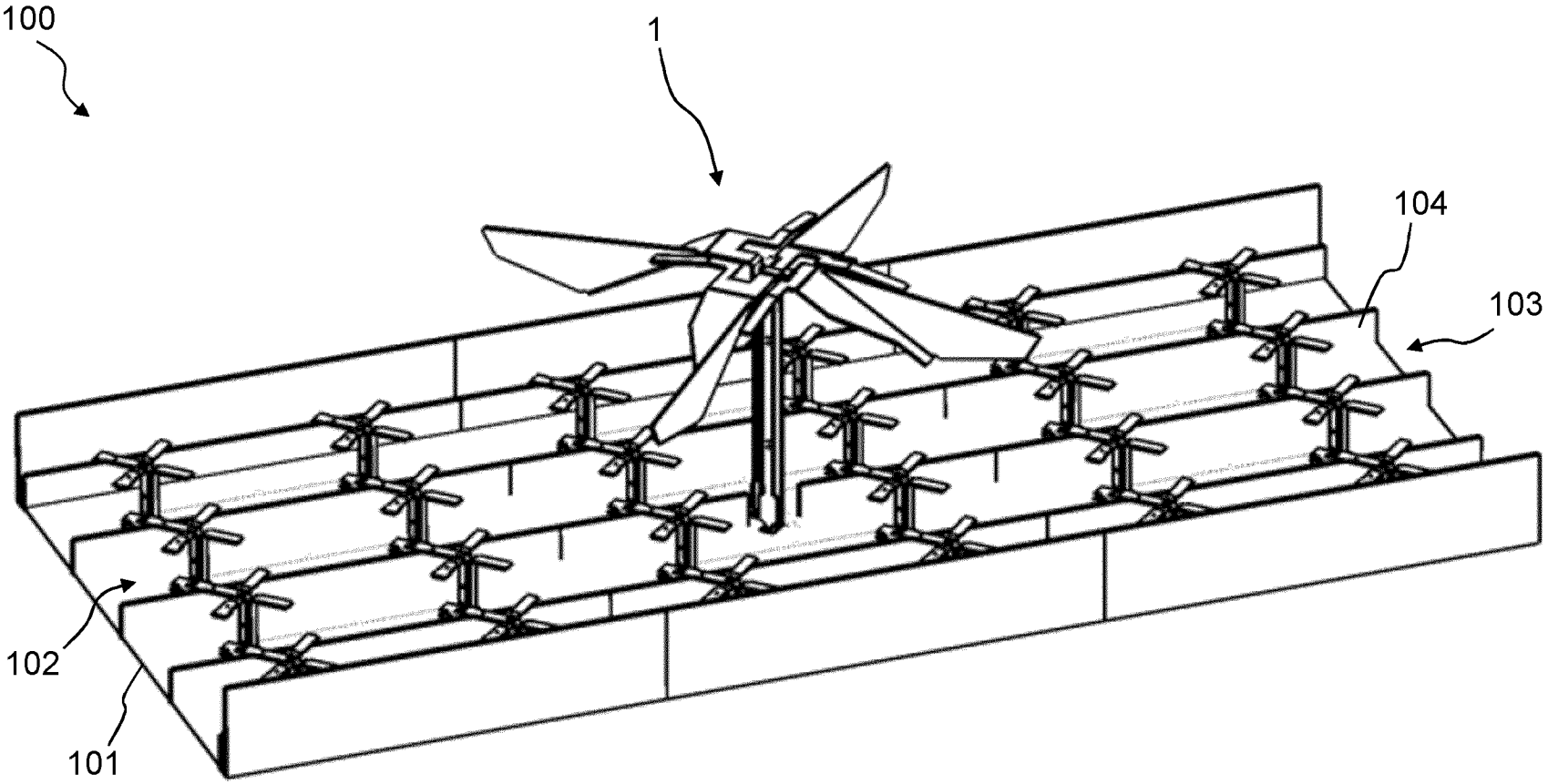
FIG. 9: a spatial view of the antenna arrangement according to the invention from FIG. 8.

FIG. 9 shows a spatial representation of the view from FIG. 8. The dual-polarised turnstile antenna 1 protrudes much further from the reflector arrangement 101 than the other higher-frequency turnstile antennas 102.

Figure 10:
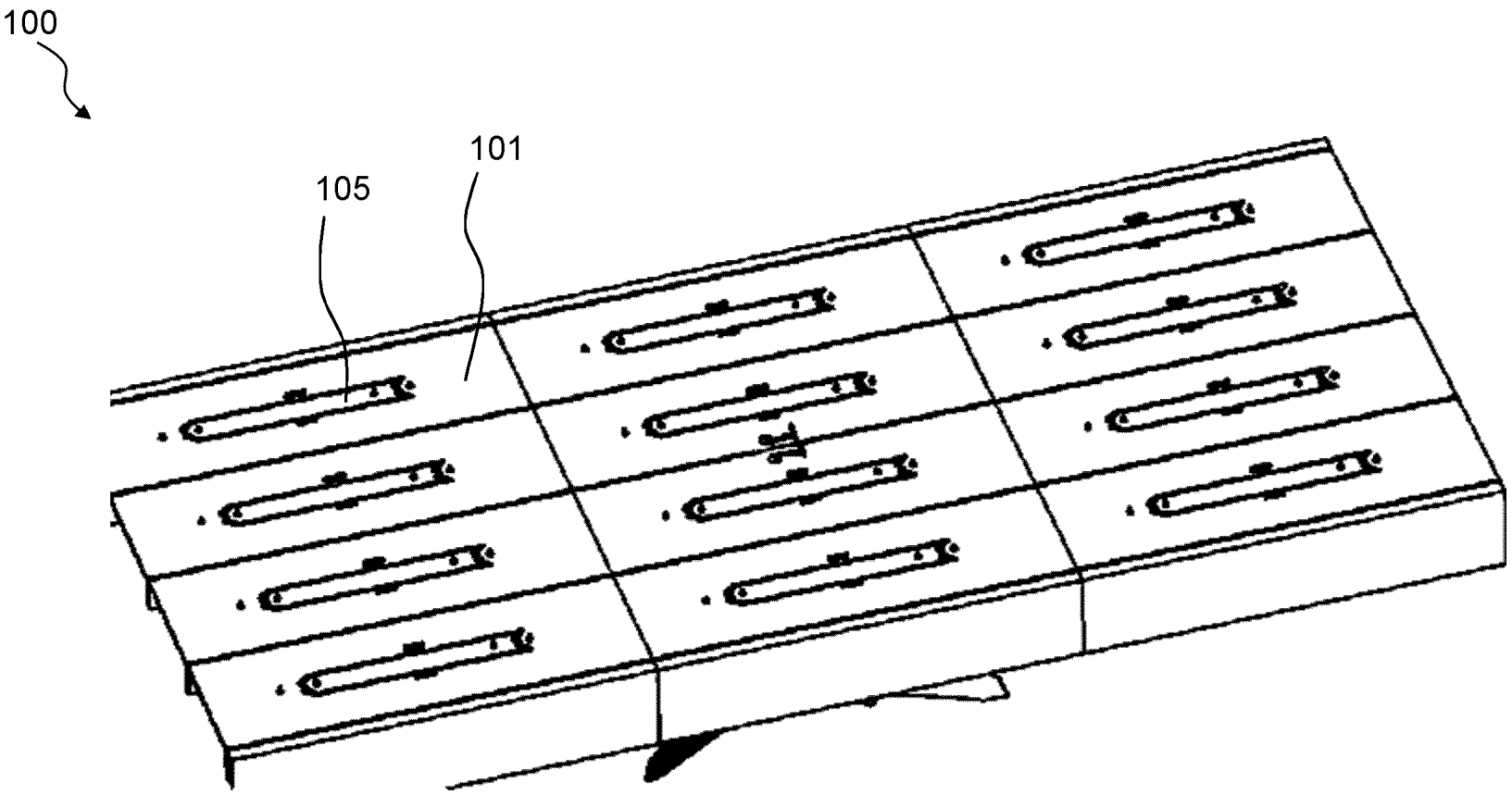
FIG. 10: a view of an underside of a reflector arrangement of the antenna arrangement according to the invention from FIGS. 8 and 9.

FIG. 10 shows a view of the underside of the reflector arrangement 101. The higher-frequency turnstile antennas 102 are also preferably mounted in separate base bodies 105, which are inserted into a corresponding opening of the reflector arrangement 101. As a result, the higher-frequency turnstile antennas 102 can be preassembled separately and inserted into the reflector arrangement 101 for final assembly. The corresponding feed lines are not shown.

The signal connection mediums 7 of both dipole antenna elements 2, 3 are preferably fed exclusively at their respective second ends 7*b*.

The dual-polarized turnstile antenna 1 is free or, with the exception of the second ends 4*b*, 7*b* of the ground connection medium 4 and/or the signal connection medium 7, free of soldering points and/or cables.

The sum of the length l and the height h of the dipole section 5 can be more than 70%, 80%, 90%, 100%, 110% or more than 120% but less than 130%, 120%, 110%, 100%, 90% or less than 80% of the sum of the length L and the width B of the coupling section 6, which is galvanically connected to the dipole section 5.

The coupling gap 8 between two adjacent dipole halves 2*a*, 2*b*, 3*a*, 3*b* is preferably designed and arranged to run asymmetrically in such a way that the coupling gap 8 is offset from the bisecting lines between the dipole halves 2*a*, 2*b*, 3*a*, 3*b*.

The invention is not restricted to the exemplary embodiments described. In the context of the invention, all of the described and/or drawn features can be combined with one another at will.

The invention claimed is:

1. An antenna arrangement for mobile radio systems with at least one dual-polarised turnstile antenna with the following features:

the at least one dual-polarised turnstile antenna is arranged on a reflector arrangement and comprises a first dipole antenna element and a second dipole antenna element which are aligned perpendicular to one another;

the first dipole antenna element comprises two dipole halves, and the second dipole antenna element comprises two dipole halves;

the first dipole half of the first dipole antenna element comprises a ground connection medium, a dipole section, and a coupling section, wherein the dipole section and the coupling section are galvanically connected to each other and to a first end of the ground connection medium, and wherein a second end of the ground connection medium, which lies opposite the first end, is arranged on the reflector arrangement;

the second dipole half of the first dipole antenna element comprises a signal connection medium, a dipole section, and a coupling section, wherein the dipole section and the coupling section are galvanically connected to each other and to a first end of the signal connection medium, and wherein a second end of the signal connection medium, which lies opposite the first end, is arranged on the reflector arrangement;

the first dipole half of the second dipole antenna element comprises a ground connection medium, a dipole section, and a coupling section, wherein the dipole section and the coupling section are galvanically connected to each other and to a first end of the ground connection medium, and wherein a second end of the ground connection medium, which lies opposite the first end, is arranged on the reflector arrangement;

the second dipole half of the second dipole antenna element comprises a signal connection medium, a dipole section, and a coupling section, wherein the dipole section and the coupling section are galvanically connected to each other and to a first end of the signal connection medium, and wherein a second end of the signal connection medium, which lies opposite the first end, is arranged on the reflector arrangement;

the signal connection medium of the first dipole antenna element runs parallel to the ground connection medium of the first dipole antenna element or parallel to a component that is predominantly parallel to said ground connection medium, and the signal connection medium of the second dipole antenna element runs parallel to the ground connection medium of the second dipole antenna element or parallel to a component that is predominantly parallel to said ground connection medium;

the dipole sections of the first dipole antenna element run in opposite directions;

the dipole sections of the second dipole antenna element run in opposite directions;

the signal connection medium of the first dipole antenna element is galvanically connected or connectable to a first feed system, and the signal connection medium of the second dipole antenna element is galvanically connected or connectable to a second feed system;

the coupling sections of the first dipole antenna element each extend along the closest dipole section of the adjacent second dipole antenna element, wherein, between a coupling side of the respective coupling section of the first dipole antenna element and the respective adjacent dipole section of the second dipole antenna element, a spacing gap is formed, as a result of which a capacitive coupling occurs between the coupling side of the respective coupling section of the first dipole antenna element to the respective adjacent dipole section of the second dipole antenna element;

the coupling sections of the second dipole antenna element each extend along the closest dipole section of the adjacent first dipole antenna element, wherein, between a coupling side of the respective coupling section of the first dipole antenna element and the respective adjacent dipole section of the second dipole antenna element, a spacing gap is formed, as a result of which a capacitive coupling occurs between the coupling side of the respective coupling section of the first dipole antenna element to the respective adjacent dipole section of the second dipole antenna element.

2. The antenna arrangement according to claim 1, characterised by the following feature:

at least one coupling section or all of the coupling sections have the same circumferential length or resonance length as the dipole section of their own dipole half or deviate by less than 30%, 25%, 20%, 15%, 10%, or less than 5%.

3. The antenna arrangement according to claim 1, characterised by the following features:

at least one dipole section or all of the dipole sections extend a length l away from the first end of the respective ground connection medium or signal connection medium and have a height h and a thickness d, wherein the height h is greater than the thickness d;

at least one coupling section or all of the coupling sections:

a) extend over a length L from the first end of the ground connection medium or signal connection medium or from the dipole section of the same dipole half along the closest dipole section of the other dipole antenna element;

b) extend over a width B to the dipole section of the dipole half; and have a thickness D, wherein the length L and the width B are greater than the thickness D;

the difference between a first sum of the length l and the height h of the dipole section and a second sum of the length L and the width B of the coupling section that is galvanic ally connected to the dipole section is less than 30%, 25%, 20%, 15%, 10%, or less than 5% of the first sum.

4. The antenna arrangement according to claim 3, characterised by the following feature:

the length L of the at least one coupling section or all of the coupling sections is greater than its width B; or the length L of the at least one coupling section or all of the coupling sections is less than its width B.

5. The antenna arrangement according to claim 3, characterised by the following feature:

at least one coupling section or all of the coupling sections are galvanically connected over their entire width B or only over part of their width B to the respective dipole section of the same dipole half.

6. The antenna arrangement according to claim 3, characterised by the following features:

the length L of at least one coupling section or all of the coupling sections is less than or equal to the length l of the closest dipole section of the other dipole antenna element along which the respective coupling section extends; and/or the width B of at least one coupling section or all of the coupling sections is smaller than the length l of the dipole section of the same dipole half; or the width B of at least one coupling section or all of the coupling sections is equal to or greater than the length l of the dipole section of the same dipole half.

7. The antenna arrangement according to claim 3, characterized by the following feature:

the longitudinal extent of at least one coupling section or all of the coupling sections, when viewed from above and starting from the associated dipole section to which they are galvanically connected, run in particular parallel to the closest adjacent dipole section of the adjacent dipole antenna element, wherein the coupling section has, when seen from above, at least two areas forming at least one gradation such that the area of the coupling section located immediately adjacent to the adjacent dipole section has a greater longitudinal extent than the area of the coupling section which is farther away from the adjacent dipole section.

8. The antenna arrangement according to claim 3, characterized by the following feature:

at least one coupling section or all of the coupling sections are arranged, in the direction of their open end on which the coupling side is formed, at least adjacent to the closest dipole section of the adjacent dipole antenna element and at least over a portion of their length so that they a) run parallel to the reflector arrangement, or b) converge on the reflector arrangement, or c) diverge away from the reflector arrangement.

9. The antenna arrangement according to claim 3, characterized by the following feature:

at least one coupling section or all of the coupling sections adjacent to the closest dipole section of the adjacent dipole antenna element comprise a coupling lug that extends over the entire length Lor only over part of the length L of the respective coupling section on its coupling side and is thus bent in the direction of the reflector arrangement, thereby increasing the coupling area and thus the coupling between the respective coupling section and the respective closest dipole section of the adjacent dipole antenna element.

10. The antenna arrangement according to claim 3, characterized by the following feature:

at least one coupling section or all of the coupling sections comprise at least one indentation or recess, which is located on the coupling side of the coupling section and along the adjacent dipole section of the other dipole antenna element and which increases the length L of the coupling section.

11. The antenna arrangement according to claim 1, characterized by the following feature:

the height relative to the reflector arrangement, up to which at least one dipole section or all dipole sections extend, decreases towards the free end of the corresponding dipole section.

12. The antenna arrangement according to claim 11, characterised by the following features:

the antenna arrangement comprises a housing cover;

the height of the at least one dipole section or of all dipole sections is adapted to the shape of the housing cover, for which purpose the height of the at least one or all of the dipole sections decreases towards the free ends of the reflector arrangement.

13. The antenna arrangement according to claim 1, characterised by the following features:

at least one dipole section or all dipole sections comprise at least one top surface Oft), one bottom surface, one end surface, and two side surfaces;

the top surface extends from the first end of the ground connection medium or signal connection medium parallel to the reflector arrangement or inclined in the direction of the reflector arrangement up to the end surface;

the bottom surface extends from the first end or is offset from the first end of the ground connection medium or signal connection medium in the direction of the reflector arrangement until the end surface, wherein the bottom surface is inclined more in the direction of the reflector arrangement than the top surface, as a result of which the height of the first and second side surfaces in the area of the end surface is greater than in the area of the first end of the ground connection medium or the signal connection medium.

14. The antenna arrangement according to claim 13, characterised by the following feature:

the coupling section, which is galvanically connected to the dipole section, is only connected to the top surface of the dipole section in a partial length of the dipole section and ends at and end area that is at a distance from the end surface of the dipole section;

an extent of the coupling section away from the dipole section in creases increases from the end area to the open end of the coupling section at the closest dipole section of the adjacent dipole antenna element in a stepped and/or continuous manner.

15. The antenna arrangement according to claim 1, characterized by the following features:

at least one dipole section or all dipole sections comprise at least one top surface, one bottom surface, one end surface, and two side surfaces;

the top surface extends from the first end of the ground connection medium or signal connection medium in the direction of the end surface parallel to the reflector arrangement or inclined in the direction of the reflector arrangement;

the bottom surface of the dipole section extends from the first end or is offset from the first end of the ground connection medium or signal connection medium in the direction of the end surface until a turning point in an orientation that is inclined with respect to the reflector arrangement.

16. The antenna arrangement according to claim 15, characterised by the following features:

the corresponding coupling section, which is galvanically connected to the dipole section, comprises:

a) a first area, with the corresponding coupling section being arranged in the first area approximately parallel to the reflector arrangement; and/or b) a second area, wherein the corresponding coupling section, in the second area, runs from the top surface of the dipole section via the first side surface of the dipole section until the turning point on the bottom surface of the dipole section and is therefore inclined in the direction of the reflector arrangement; and/or an extent of the coupling section away from the dipole section increases from the turning point to the open end of the coupling section at the closest dipole section of the adjacent dipole antenna element in a stepped and/or continuous manner; and/or the bottom surface of the dipole section runs from the first end of the ground connection medium or signal connection medium in the direction of the end surface in an orientation that is inclined with respect to the reflector arrangement until a turning point in order to then increase along its further extent while increasing the distance to the reflector arrangement, as a result of which the height of the first and second side surfaces of the dipole section is larger in the area of the turning point than in the area of the end surface of the dipole section.

17. The antenna arrangement according to claim 15, characterised by the following feature:

the bottom surface comprises a jump at the turning point in the direction of the reflector arrangement and runs from there parallel or inclined to the reflector arrangement or away from the reflector arrangement in the direction of the end surface.

18. The antenna arrangement according to claim 1, characterized by the following features:

at least one dipole section or all dipole sections comprise at least one top surface, one bottom surface, one end surface, and two side surfaces;

the top surface runs from the first end of the ground connection medium or signal connection medium parallel to the reflector arrangement or is inclined in the direction of the reflector arrangement until the end surface;

the bottom surface of the dipole section runs from the first end or offset from the first end of the ground connection medium or signal connection medium in the direction of the end surface;

the bottom surface comprises a stepped and/or continuous tapering or curved transition in the direction of the reflector arrangement.

19. The antenna arrangement according to claim 1, characterized by the following feature:

at least one coupling section or all of the coupling sections are rectangular; and/or at least one dipole section or all dipole sections are rectangular.

20. The antenna arrangement according to claim 1, characterized by the following feature:

at least one coupling section or all of the sections originate at the first end of the respective ground connection medium or signal connection medium of the same dipole half or on the respective dipole section the same dipole half.

* * * * *